US011072942B2

(12) United States Patent
Dotterweich et al.

(10) Patent No.: US 11,072,942 B2
(45) Date of Patent: Jul. 27, 2021

(54) INSTANT CANOPY FRAME WITH BUILT-IN HUBS FOR AN ASSORTMENT OF ATTACHMENTS

(71) Applicants: Martin Dotterweich, Escondido, CA (US); Charles Brewer, Bentonville, AR (US)

(72) Inventors: Martin Dotterweich, Escondido, CA (US); Charles Brewer, Bentonville, AR (US)

( * ) Notice: Subject to any disclaimer, the term of this patent is extended or adjusted under 35 U.S.C. 154(b) by 0 days.

(21) Appl. No.: 16/167,380

(22) Filed: Oct. 22, 2018

(65) Prior Publication Data

US 2019/0292808 A1 Sep. 26, 2019

Related U.S. Application Data

(60) Provisional application No. 62/575,490, filed on Oct. 22, 2017.

(51) Int. Cl.

| | |
|---|---|
| ***E04H 15/32*** | (2006.01) |
| ***E04H 15/02*** | (2006.01) |
| *E04H 15/50* | (2006.01) |

(52) U.S. Cl.

CPC ..... *E04H 15/32* (2013.01); *E04H 15/02* (2013.01); *E04H 15/50* (2013.01)

(58) Field of Classification Search

CPC . E04H 15/02; E04H 15/32; A45B 2200/1009; A45B 2200/1054; A45B 2200/1063

See application file for complete search history.

(56) References Cited

U.S. PATENT DOCUMENTS 7,240,685 B2 * 7/2007 Seo ..... E04H 15/50 135/120.3

FOREIGN PATENT DOCUMENTS

NL 1008036 C1 * 7/1999 ..... A45B 23/00

* cited by examiner

*Primary Examiner* — David R Dunn
*Assistant Examiner* — Danielle Jackson
(74) *Attorney, Agent, or Firm* — John K. Buche; Bryce A. Johnson; Buche & Associates, P.C.

(57) ABSTRACT

A novel canopy frame hub, or bracket, that features insert openings on all four sides to receive attachment pegs of outdoor accessories, such as flags, banners, awnings, racks, garbage bags, drink holders, tables, shelves, gutters, and tents. The frame hub encompass a leg of a traditional canopy frame and may be adjusted vertically to a desired height by sliding the bracket along the frame leg. The hub may then be fixated at the desired height via the twisting of a fixed screw inserted through an opening in one side of the hub.

1 Claim, 53 Drawing Sheets

INSTANT CANOPY FRAME WITH BUILT-IN HUBS FOR AN ASSORTMENT OF ATTACHMENTS

CROSS-REFERENCE TO RELATED APPLICATIONS

This application claims the benefit of U.S. Provisional Application No. 62/575,490, filed Oct. 22, 2017. This document is incorporated by reference in its entirety.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

REFERENCE TO AN APPENDIX SUBMITED ON A COMPACT DISC AND INCORPORATED BY REFERENCE OF THE MATERIAL ON THE COMPACT DISC

Not applicable.

STATEMENT REGARDING PRIOR DISCLOSURES BY THE INVENTOR OR A JOINT INVENTOR

Reserved for a later date, if necessary.

BACKGROUND OF THE INVENTION

Field of Invention

The disclosed subject matter is in the field of pop-up shelters.

Background of the Invention

Deconstructable canopy frames provide a multitude of uses for outdoor recreational activities. Such frames have become essential for protection from sun and rain while also providing a temporary sanctuary for dining, resting, and outdoor play. Further, canopy frames have become more and more reliable as brand identifiers—displaying brand names so that the vender using the frame may be easily located by searching pedestrians in a crowded outdoor area.

Traditional canopy frames merely provide a sheltering frame; however, rarely do users utilize canopy frames for nothing more than sitting beneath them. Canopy frames are used in conjunction with a variety of outdoor activities, such as camping, tailgating, or marketing. All of these activities entail several hours of outdoor time and require additional gear that must be brought separately and assembled independently of the canopy frame. These additional items are burdensome to pack and unpack. Especially for items such as banners and trash bags, which require additional attachment means to connect the items to the canopy frame. When such products are simply hung on the trusses of the canopy, the framework is weakened because the trusses bend under the weight of the hung-up items.

Thus, a need exists for attachment means incorporated into a canopy frame so as to avoid the excessive and burdensome packing that is now required for outdoor activities.

SUMMARY OF THE INVENTION

In view of the foregoing, an object of this specification is to disclose a novel canopy frame hub, or bracket, that features insert openings on all four sides as well as leg adjustments. The frame hub encompass a leg of a traditional canopy frame and may be adjusted vertically to a desired height by sliding the bracket along the frame leg. The hub may then be fixated at the desired height via the twisting of a fixed screw inserted through an opening in one side of the hub.

The insert openings on the sides of each hub permit a user to easily and removably attach a variety of useful accessories such as: flags, banners, awnings, racks, garbage bags, drink holders, tables, shelves, gutters, and tents. Currently canopy frames lack adjustable hubs with built-in insert openings, requiring users to use alternative means to attach items to the frame, such a zip ties or ropes. The frame hubs of the present invention not only provide an adjustable attachment means, but they require less work for a user who would otherwise have to remember the loose parts (rope, zip ties, etc.) and construct attachment means with those loose parts.

Another objective of this disclosure is to describe various embodiments of hubs for various functional attachments or accessories with a wide variety of uses. In some cases, the hubs are integrated on a framework for a pop-up canopy or other shelter. It is another objective to describe hubs that easily attach to the framework in a manner that eliminates loose parts (i.e., parts capable of being lost). Yet another objective is to describe the integrated hubs in a way that enables establishment of the framework without interfering with the put-up or take down of the framework. In some instances, the hubs feature vertical openings that are easily accessible when the canopy or shelter framework is erected. Suitably, the hubs may be identified via one or more of said vertical openings on either of the 1 or more openings on either the slider, the leg adjustment mechanism or the bottom of the outer or upper leg. In one mode of use, multiple accessories will be available to enhance the popular uses of Instant Canopies during e.g.: tailgating; street fairs; farmers markets; promotional events; community events and sporting events. Suitably, the hubs have a multiplicity of benefits, including: providing a clean professional look for attaching accessories to the framework without unsightly clamps or homemade attachments. Preferably, the hubs are easy to use and are inexpensive. Finally, it is preferable that the hubs enable installation of a bar or pole from leg to leg in 2 locations where the bar or pole is strong enough to hold display walls or merchandise.

BRIEF DESCRIPTION OF THE SEVERAL VIEWS OF THE DRAWINGS

Other objectives of the disclosure will become apparent to those skilled in the art once the invention has been shown and described. The manner in which these objectives and other desirable characteristics can be obtained is explained in the following description and attached figures in which.

It is to be noted, however, that the appended figures illustrate only typical embodiments of this invention and are therefore not to be considered limiting of its scope, for the invention may admit to other equally effective embodiments that will be appreciated by those reasonably skilled in the relevant arts. Also, figures are not necessarily made to scale but are representative.

DETAILED DESCRIPTION OF PREFERRED EMBODIMENTS

Disclosed is a canopy frame hub which encompasses the leg of a canopy frame and receives attachments means. In the preferred embodiments, the hub is defined by the leg independently, as part of the leg adjustment hub, or as part of a canopy truss support cap or attachment of the leg.

Figure 1:
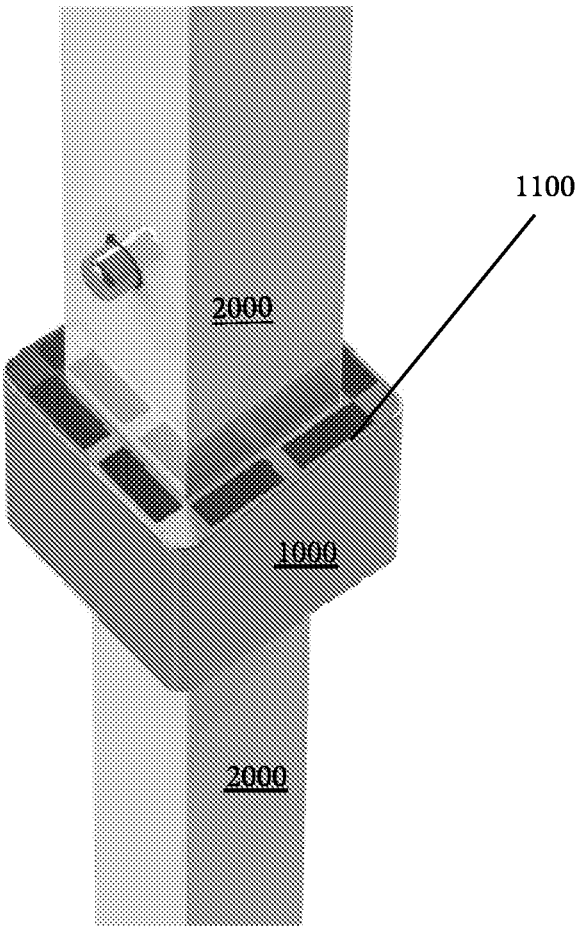
FIG. 1 is a perspective view of the frame hub surrounding a canopy frame leg.

As shown in FIG. 1, the frame hub 1000 suitably features four sides with a tunneled opening that passes through the frame hub for receiving a canopy frame leg 2000 (not shown in FIG. 1). The frame hub 1000 may be slid onto a canopy frame leg 2000 via insertion of the frame leg into the central opening of the frame hub 1000, as shown. Each side of the frame hub 1000 features attachment portals or openings 1100. Attachment accessories (such as a counter as shown in FIG. 2) may be connected to the frame hub via insertion of attachment pegs into the attachment portals.

Figures 2, 2A, 2B, 2C:
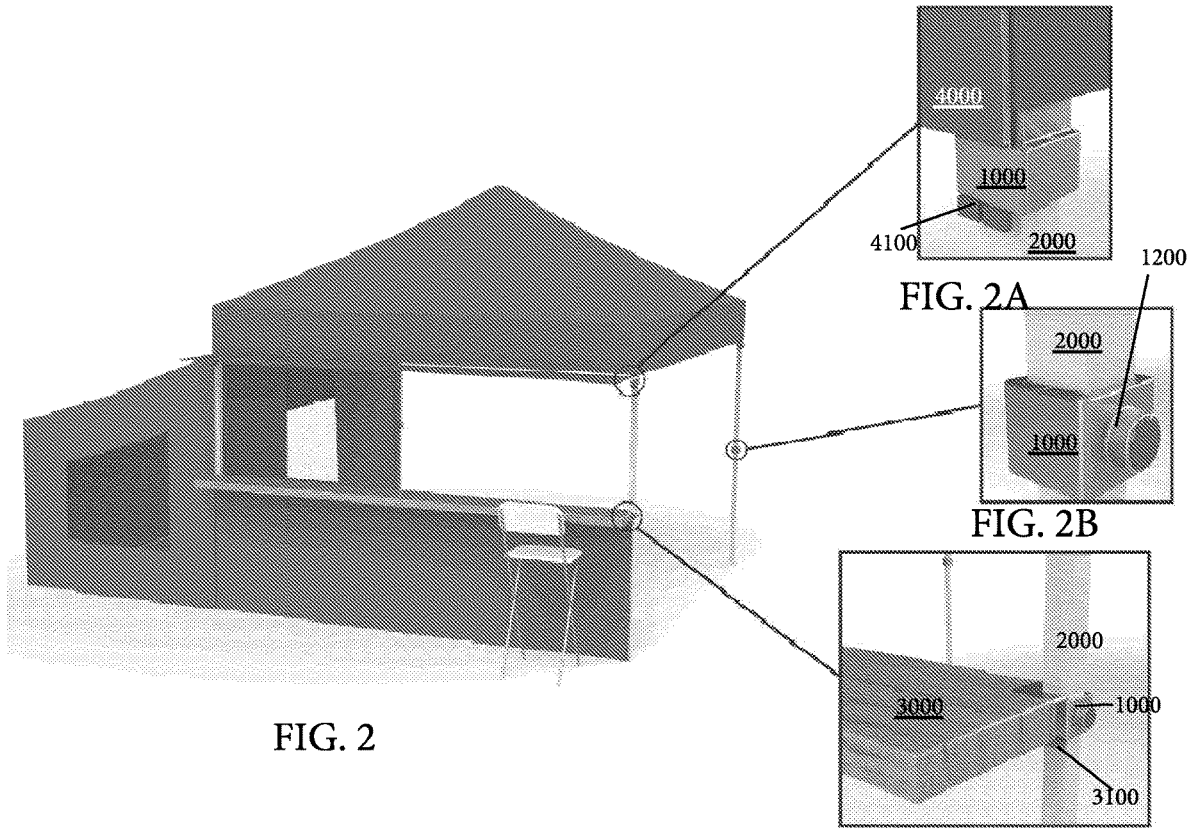
FIG. 2 is a perspective view of an environmental view of the frame hub in use.
FIG. 2A is a magnified view of the frame hub supporting an awning.
FIG. 2B is a magnified view of the frame hub showing the fixated screw.
FIG. 2C is a magnified view of the frame hub supporting a counter attachment.

FIG. 2 shows an environmental view of the frame hub 1000 in use, supporting a counter attachment 3000, and an awning attachment 4000. FIGS. 2A-C show magnified views of the frame hub 1000 in use. Referring to FIGS. 2B and C, the frame hub 1000 features an opening on one side through which a set screw 1200 is provided. A twisting of the fixed screw drives the screw through the opening and applies pressure to the canopy leg 2000 inserted into the opening of the frame hub 1000. The pressure of the screw 1200 onto the canopy frame leg 2000 maintains the vertical position of the frame hub 1000, preventing the downward sliding of the frame hub 1000 down the canopy frame leg 2000. An untwisting of the set screw 1200 alleviates the pressure, making the frame hub 1000 moveable laterally along the canopy frame leg 2000 and permitting a user to adjust the height of the frame hub.

Figure 3A:
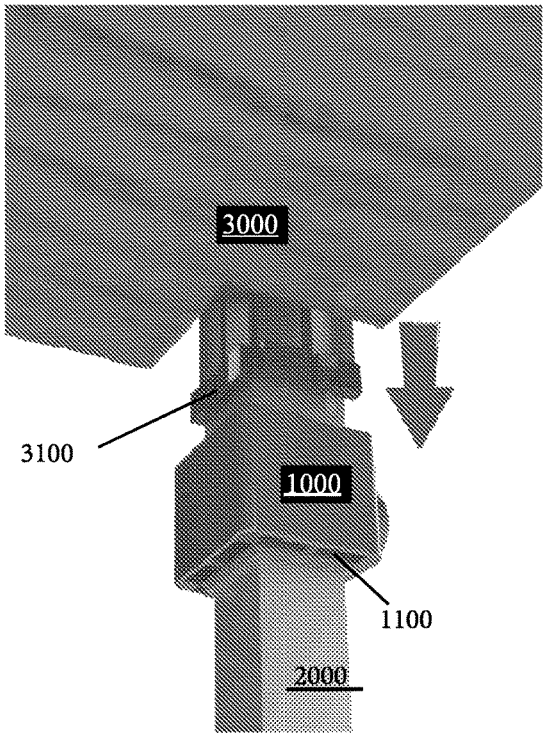
FIG. 3A is a perspective view of the frame hub unattached to a counter attachment.
Figure 3B:
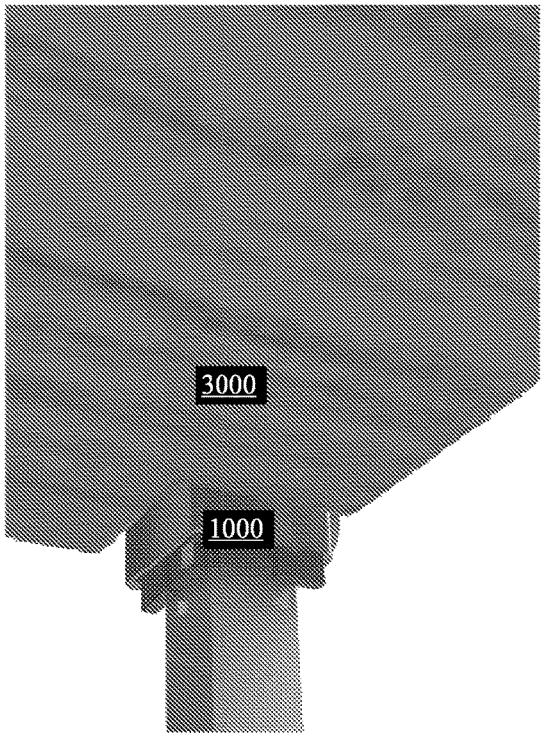
FIG. 3B is a perspective view of the frame hub connected to a counter attachment.

As shown in FIGS. 3A and B, the attachment portals 1100 on each side of the frame hub 1000 receive attachment pegs 3100 from various attachment accessories, thereby connecting the attachment accessories 3000/4000 to the canopy frame legs 2000. As shown in FIG. 3A, the attachment pegs 3100 of an attachment accessory 3000 are aligned above the frame hub 1000, such that the attachment pegs 3100 correspond to the attachment portals 1100 on the frame hub 1000. The attachment accessory is then brought downward, such that the aligned attachment pegs are inserted into the attachment portals 1100 of the frame hub 1000. The attachment pegs 3100 are pinched inward and held inward by the outer walls of the attachment portals 1100 during insertion. Once the attachment pegs 3100 emerge from the bottom opening of the attachment portals 1100, the attachment pegs 3100 spring outward, preventing the upwards movement of the attachment accessory 3000 and, thereby, locking the attachment accessory 3000 in place. FIG. 3B shows the attachment pegs 3100 extending outward from the bottom of the attachment portals 1100, thereby locking the attachment accessory in place 3000. A pinching of the attachment pegs 3100 in conjunction with the an upward pushing force allows the attachment pegs 31000 to ascend back up the attachment portals 1100 and thereby release the attachment accessory 3000 from its fixated position on the canopy leg 2000. In another embodiment, the attachment pegs are simple J-shaped hooks that insert into the attachment portals.

Figure 4:
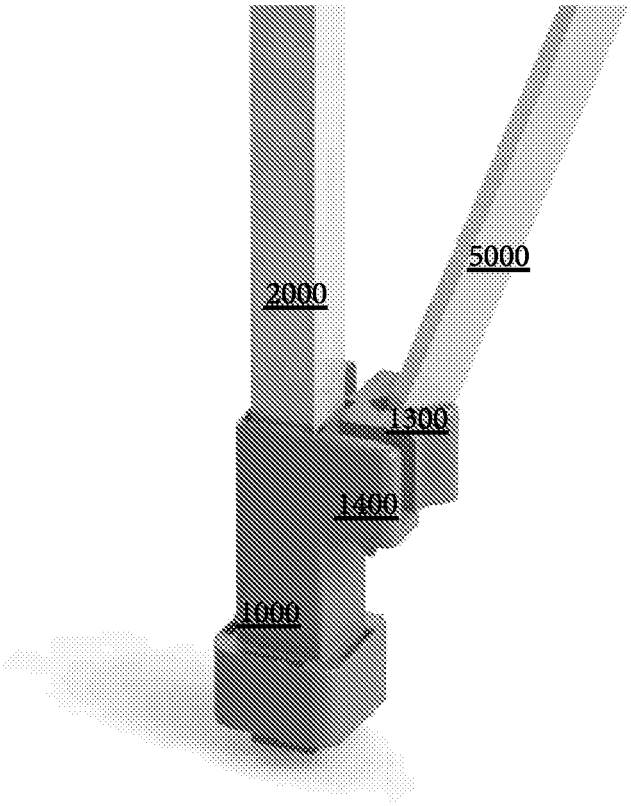
FIG. 4 is a perspective view of the frame-receiving extension.
Figure 5A:
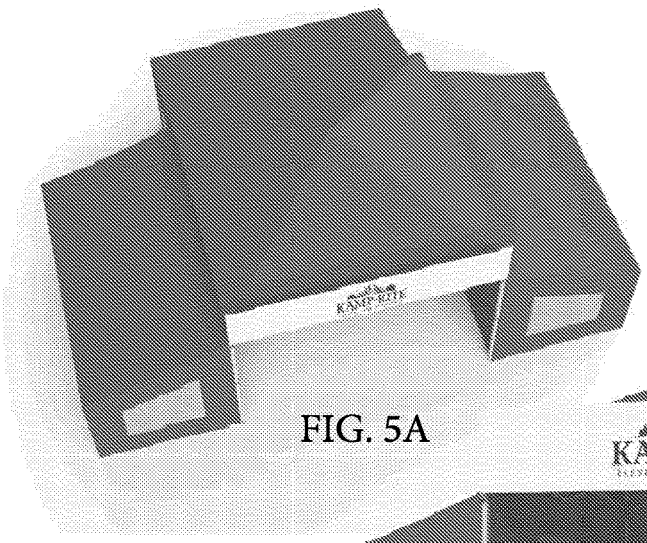
FIG. 5A is an environmental view of the frame-receiving extension in use, supporting an advertisement banner.
Figure 5B:
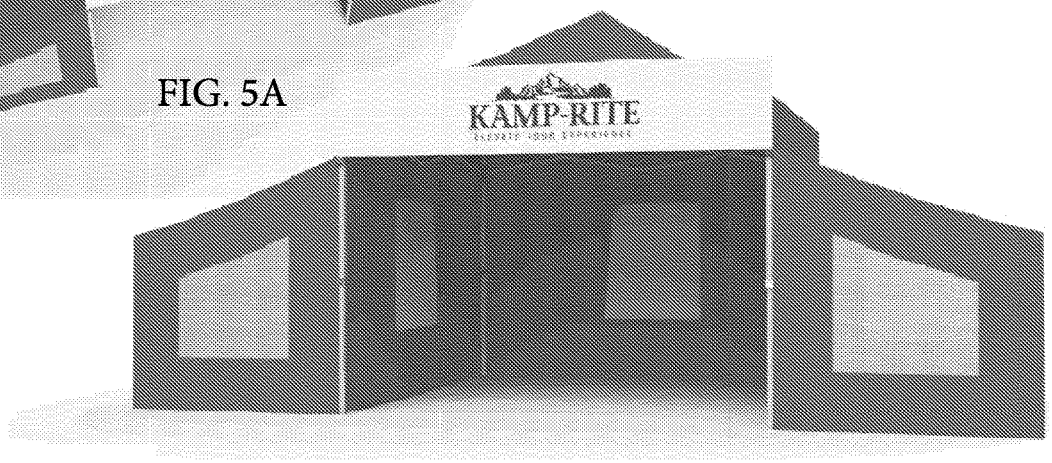
FIG. 5B is an environmental view of the frame-receiving extension in use, supporting an advertisement banner.
Figure 6:
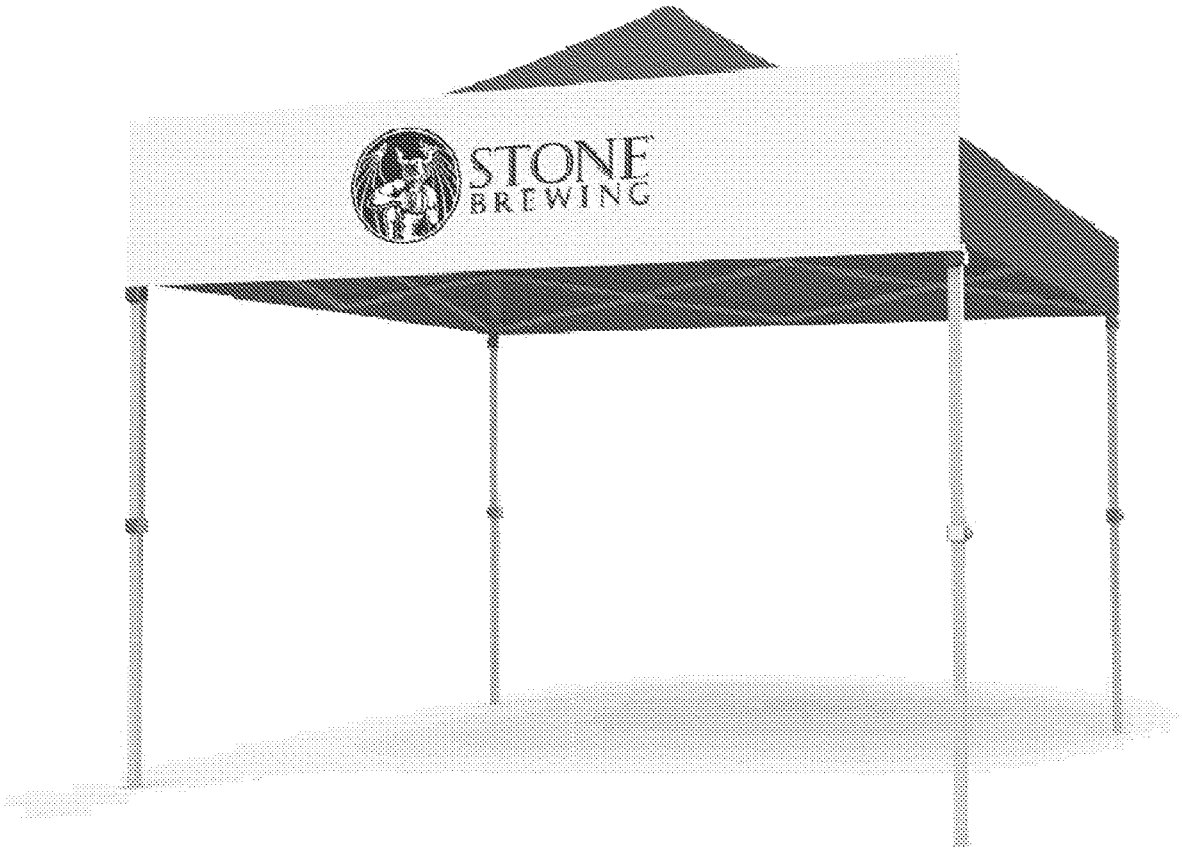
FIG. 6 is an environmental view of the frame-receiving extension supporting a sign with frame hubs also attached.

Referring to FIG. 4, the frame hub 1000 may be built into or otherwise feature truss support cap or attachment for securing a truss 5000 to the leg 2000. In this embodiment, the frame hub 1000 is also referred to as a frame hub 1000. As shown, the frame hub 1000 also encompasses the canopy frame leg 2000. The frame hub 1000 features a truss portal 1300, whereby the overhead truss of the canopy is attached. The frame-receiving extension also features two banner post portals 1400, whereby a large advertisement sign or banner may be inserted so as to display the sign without having to use additional attachment means (such as rope or zip ties). FIGS. 5 through 8 show signs being supported by the frame-receiving extension.

Figure 7:
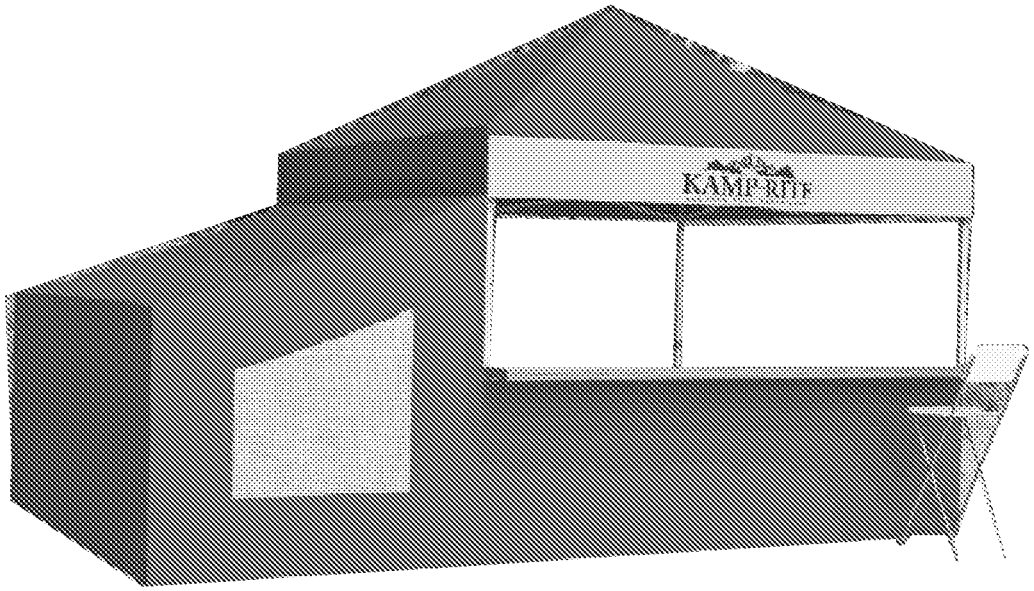
FIG. 7 is an environmental view showing the simultaneously use of the frame-receiving extension and the frame hub.
Figure 8:
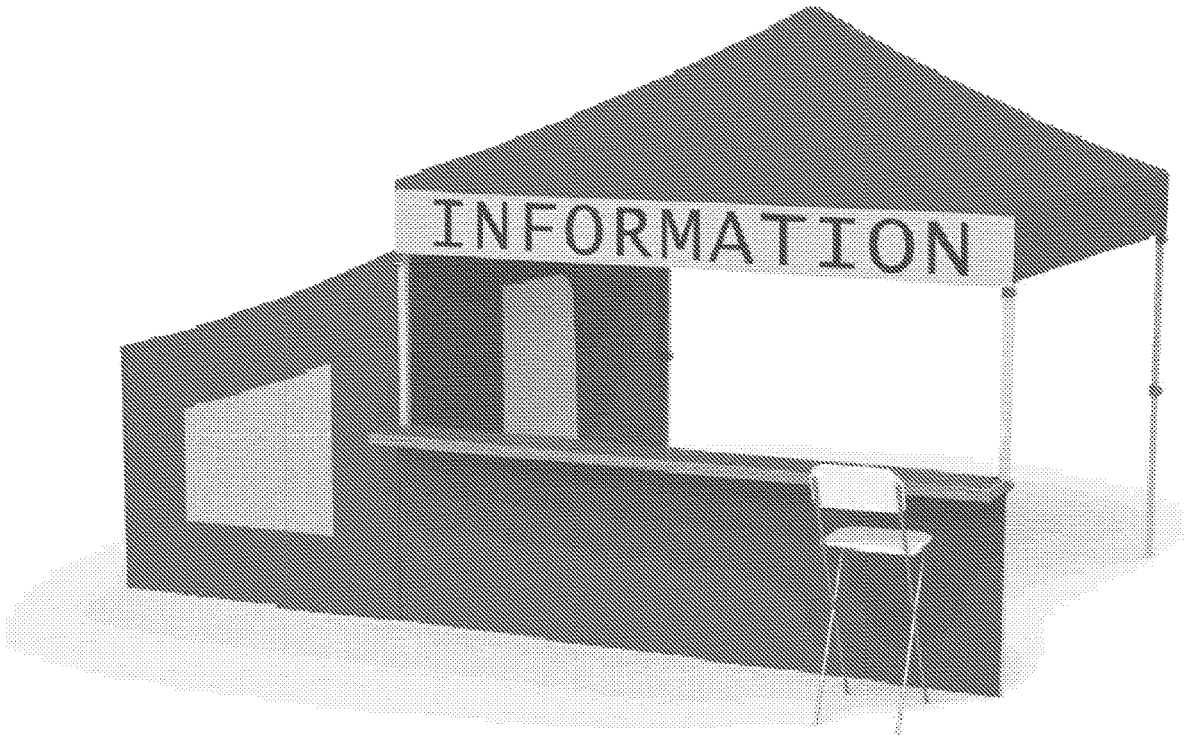
FIG. 8 is an environmental view showing the simultaneously use of the frame-receiving extension and the frame hub.

As shown in FIGS. 7 and 8, the frame-receiving extension may be used simultaneously as another frame hub which may be fixated at a different height on the same frame leg.

Figure 9:
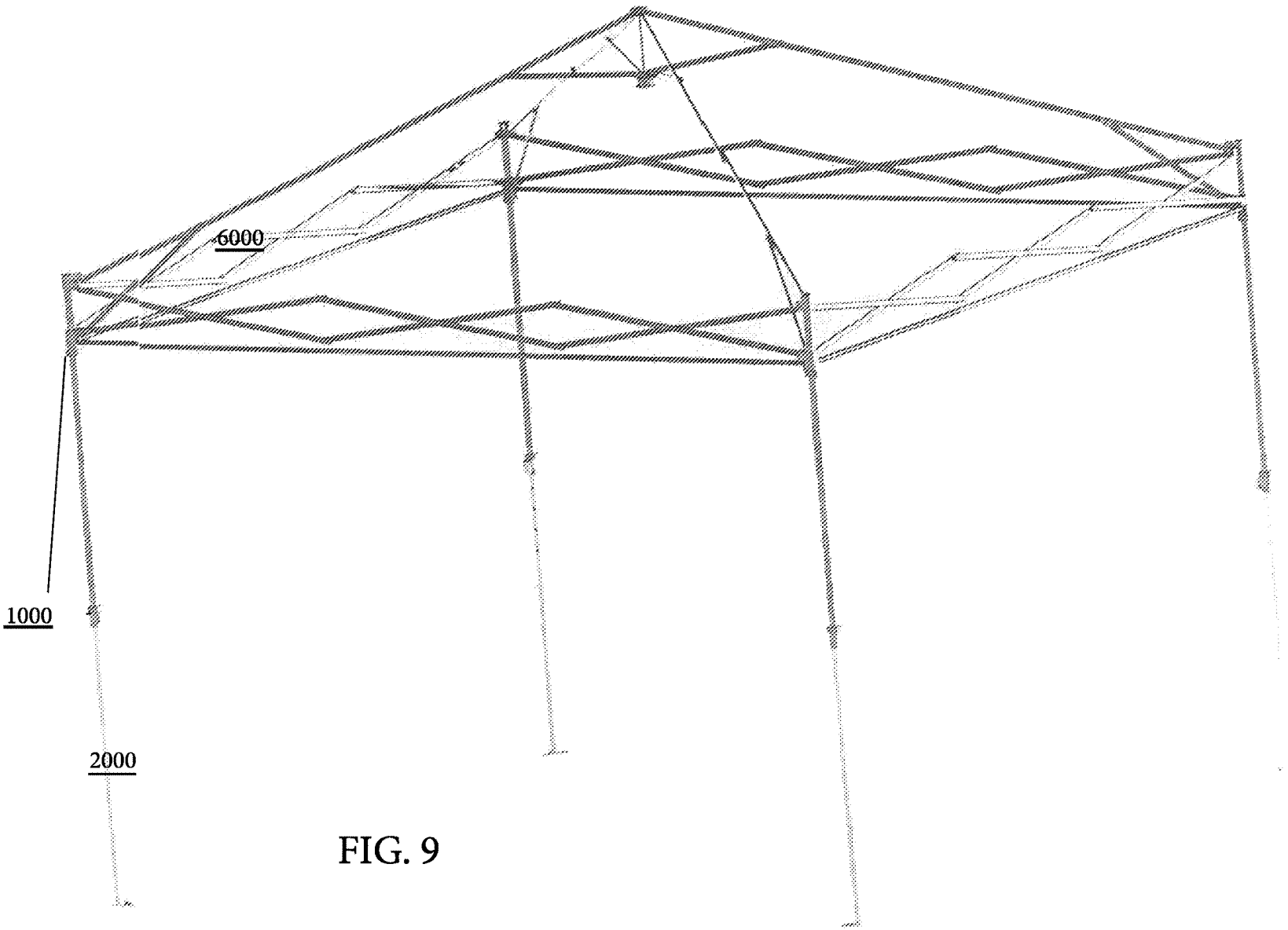
FIG. 9 is a perspective view of an example of framework for a pop-up canopy.

FIG. 9 is a perspective view of an example of framework for a pop-up canopy. As shown the canopy features trusses 6000, legs 2000, frame hubs 1000, and frame hubs 1000. A comparable framework is disclosed by U.S. Pat. No. 9,995,056 (issued Jun. 12, 2018; collapsible gazebo frame with single activation feature) and this U.S. Pat. No. 9,995,056 is hereby incorporated by reference for disclosure of similar frameworks described herein.

Figure 10:
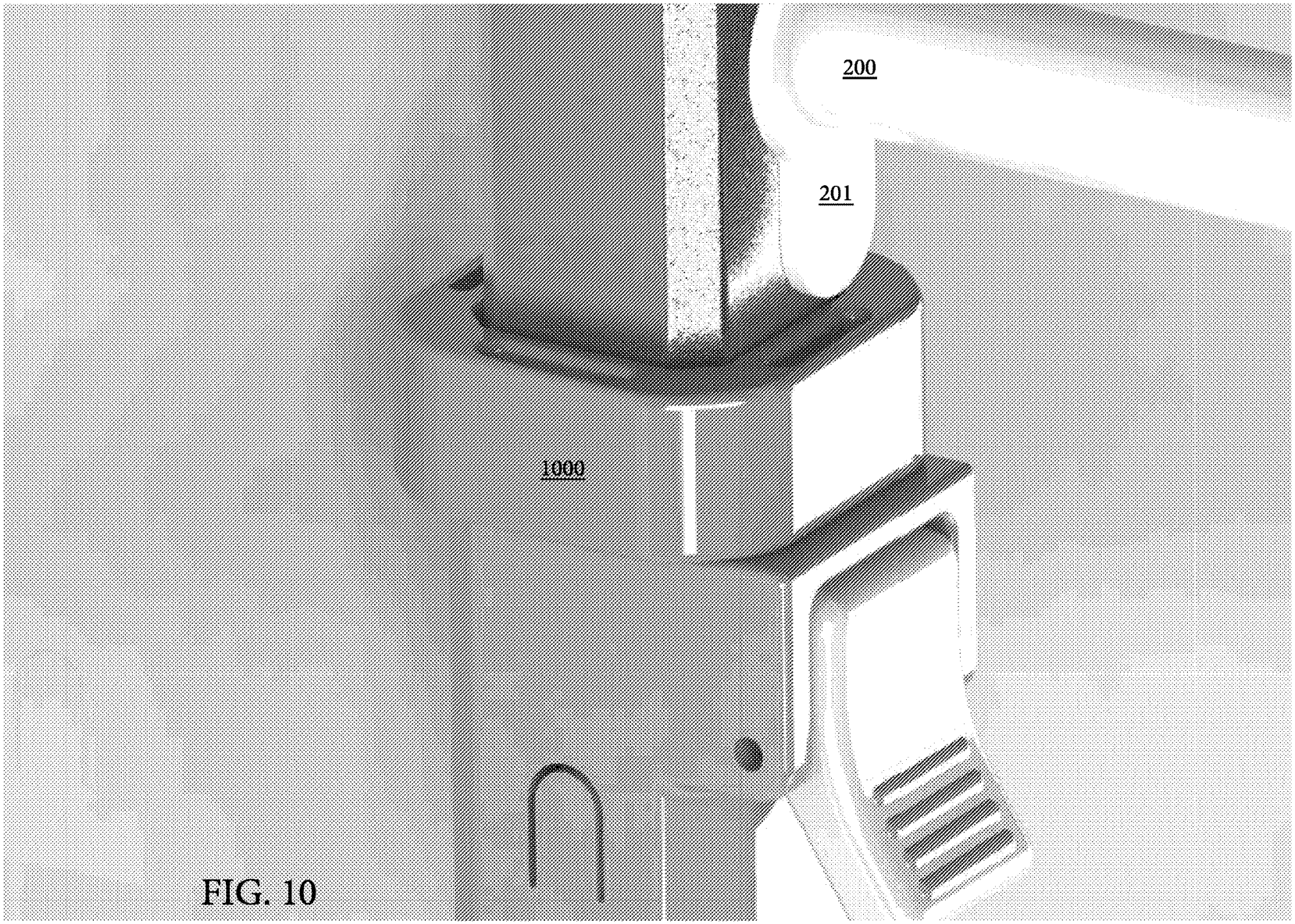
FIG. 10 is a perspective view of a leg adjustment hub and insertable accessory pole.
Figure 11:
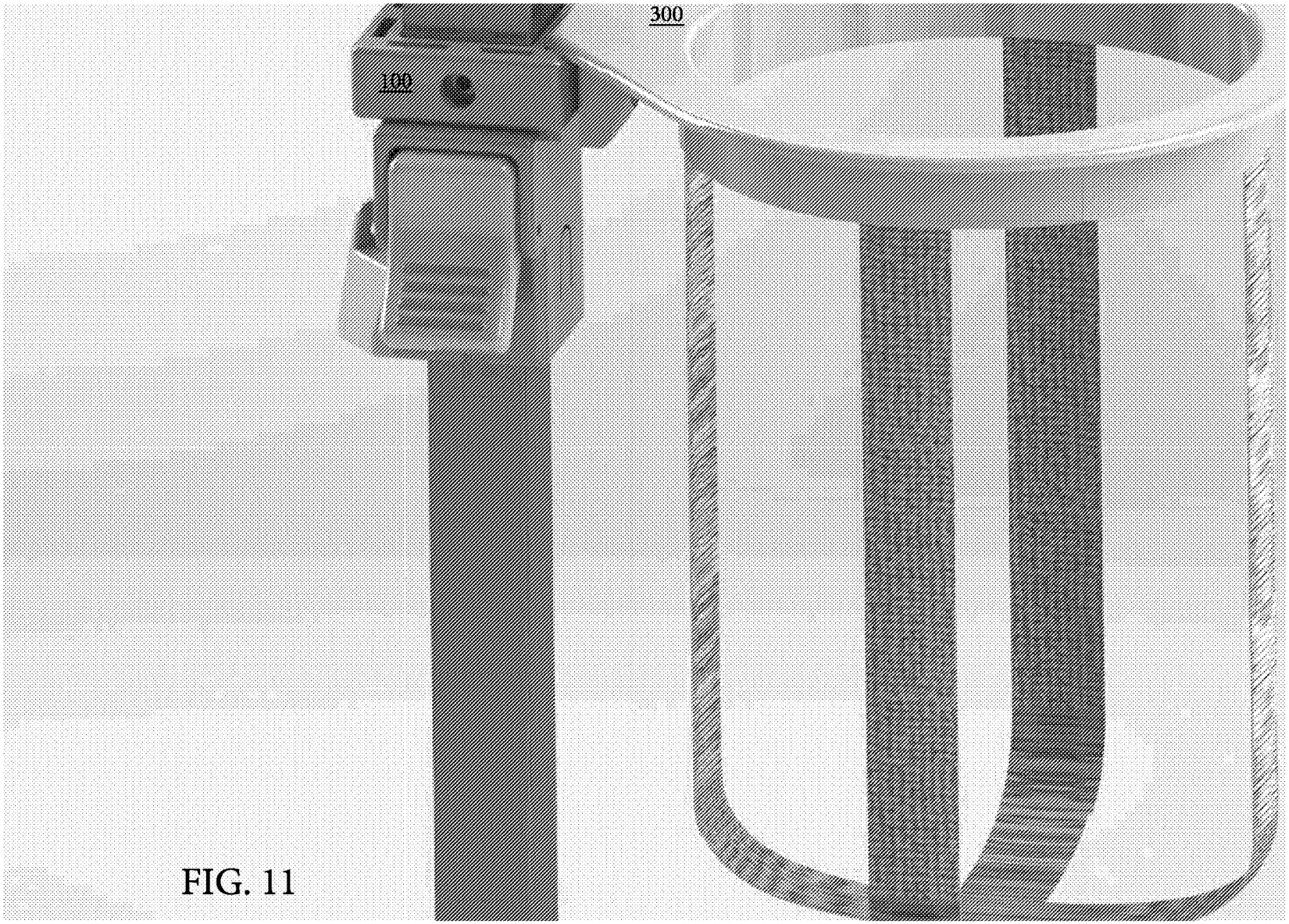
FIG. 11 is a perspective view of a leg adjustment hub with a cup holder installed in one of the vertical openings of the slider.
Figure 12:
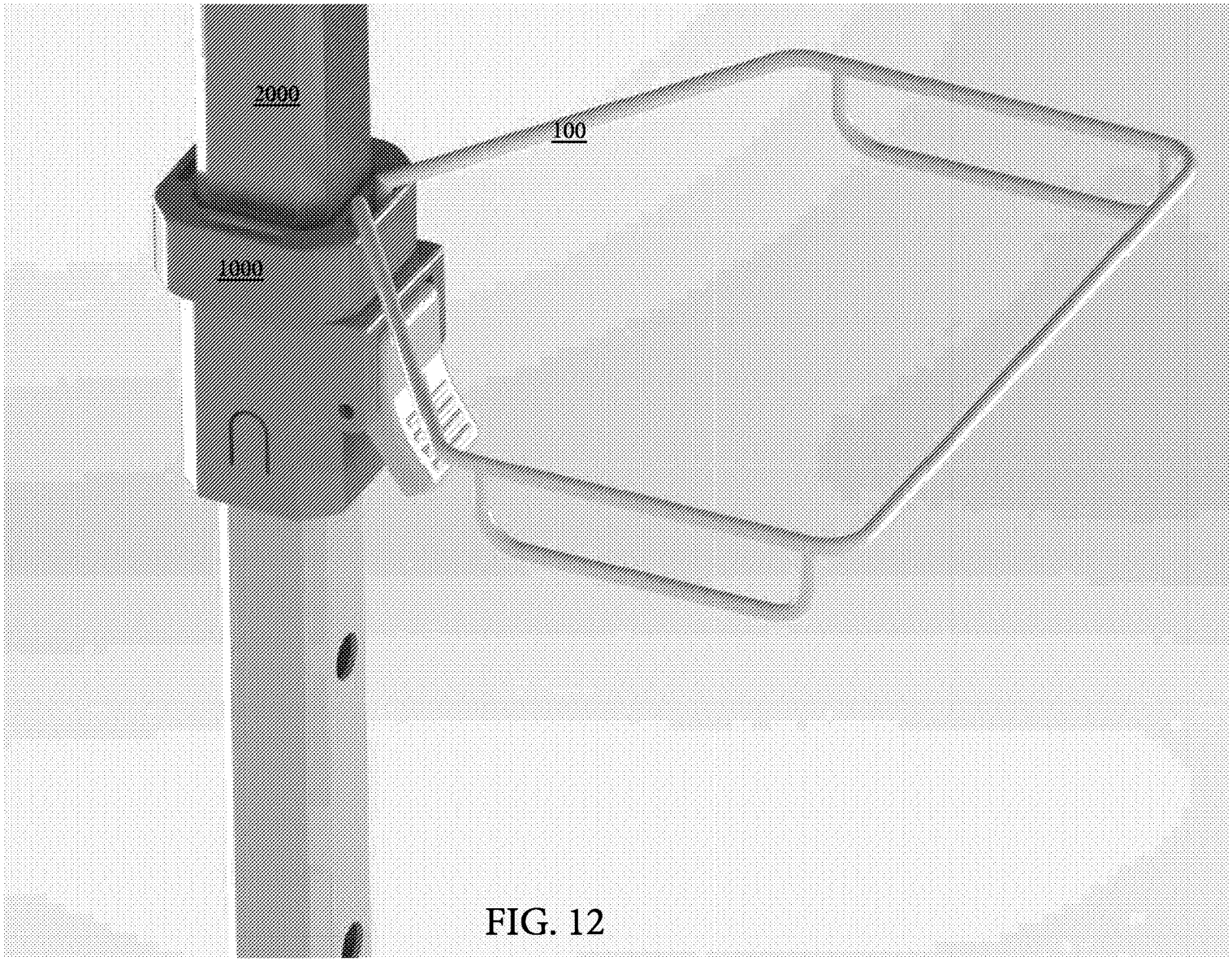
FIG. 12 is a perspective view of a leg adjustment hub with a garbage bag holder installed in one of the vertical openings of the slider.
Figure 13:
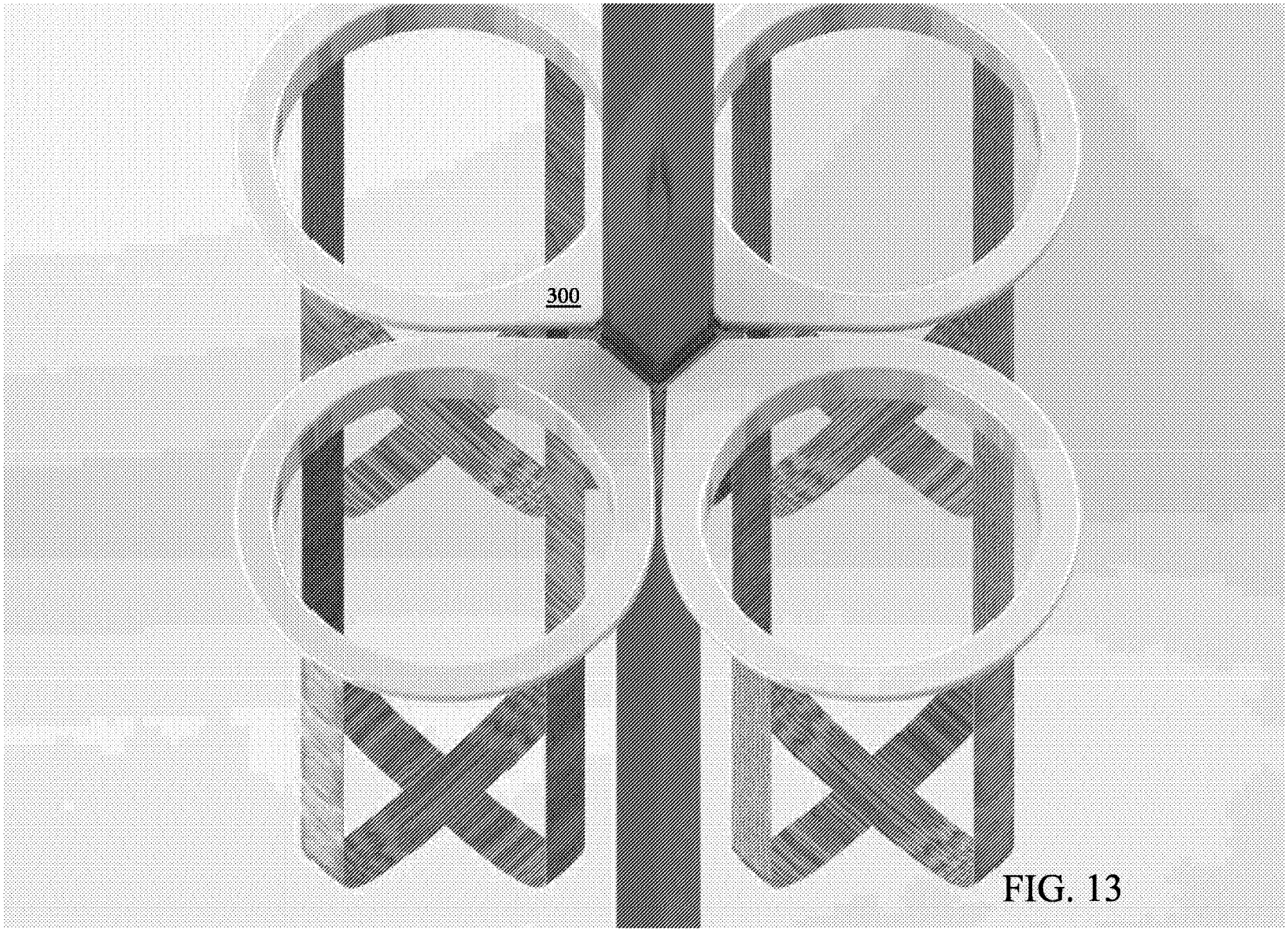
FIG. 13 is a perspective view of a leg adjustment hub with a cup holder installed in one of the vertical openings of the slider.

FIGS. 10 through 13 illustrate the frame hub 1000. FIG. 10 is a perspective view of a frame hub 1000 and insertable accessory pole 200 with a digit 201 for insertion into the portals 1100 of the hub (as shown). FIG. 11 is a perspective view of a frame hub 1000 with a cup holder 300 installed in one of the vertical openings 1100 of the frame hub 1000. FIG. 12 is a perspective view of a frame hub 1000 with a garbage bag holder 100 installed in one of the vertical openings of the frame hub 1000. FIG. 13 is a perspective view of a frame hub 1000 with a cup holder installed in one of the vertical openings of the frame hub 1000.

Figure 14:
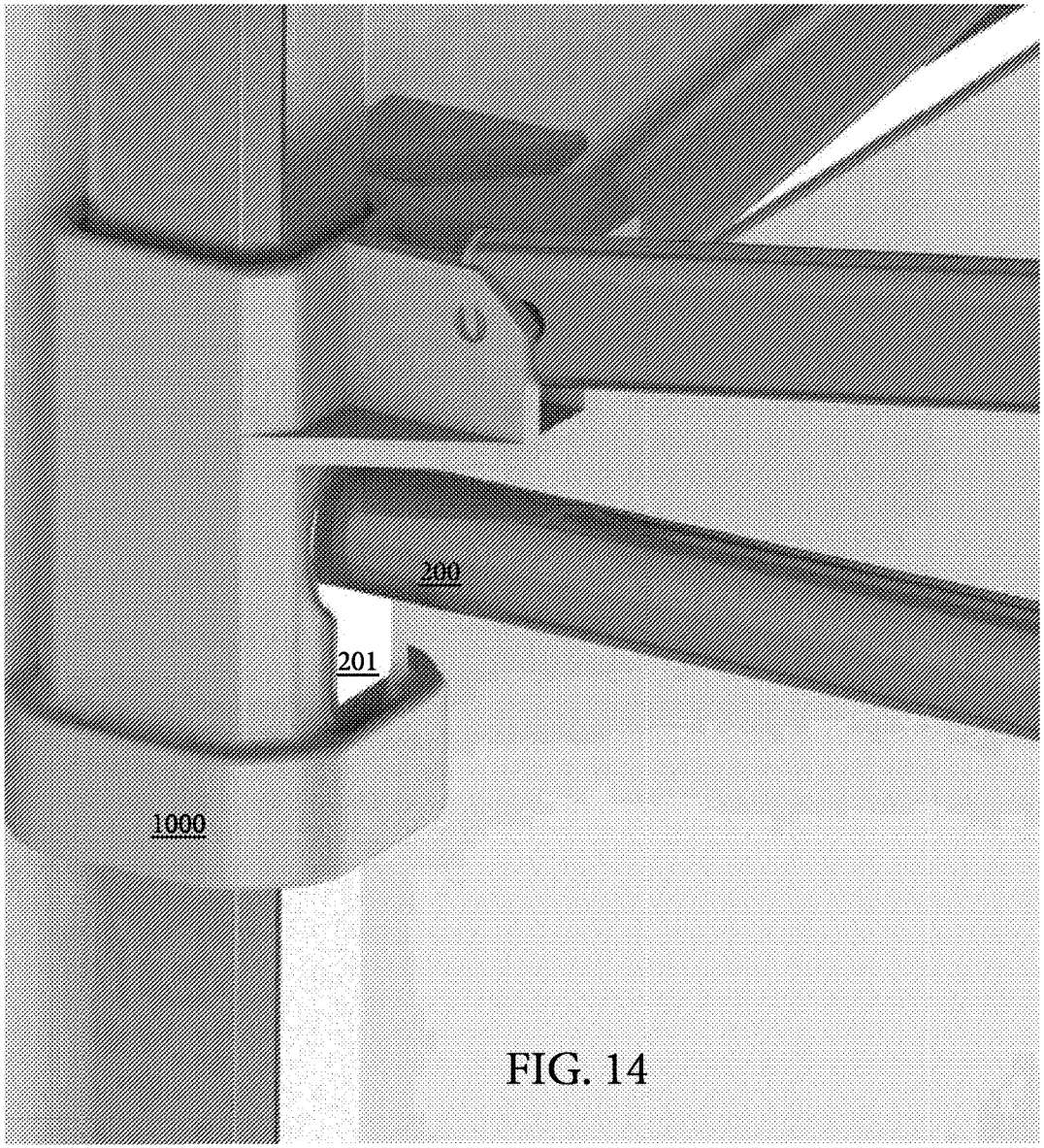
FIG. 14 is a perspective view of a truss support slider and insertable accessory pole.
Figure 15:
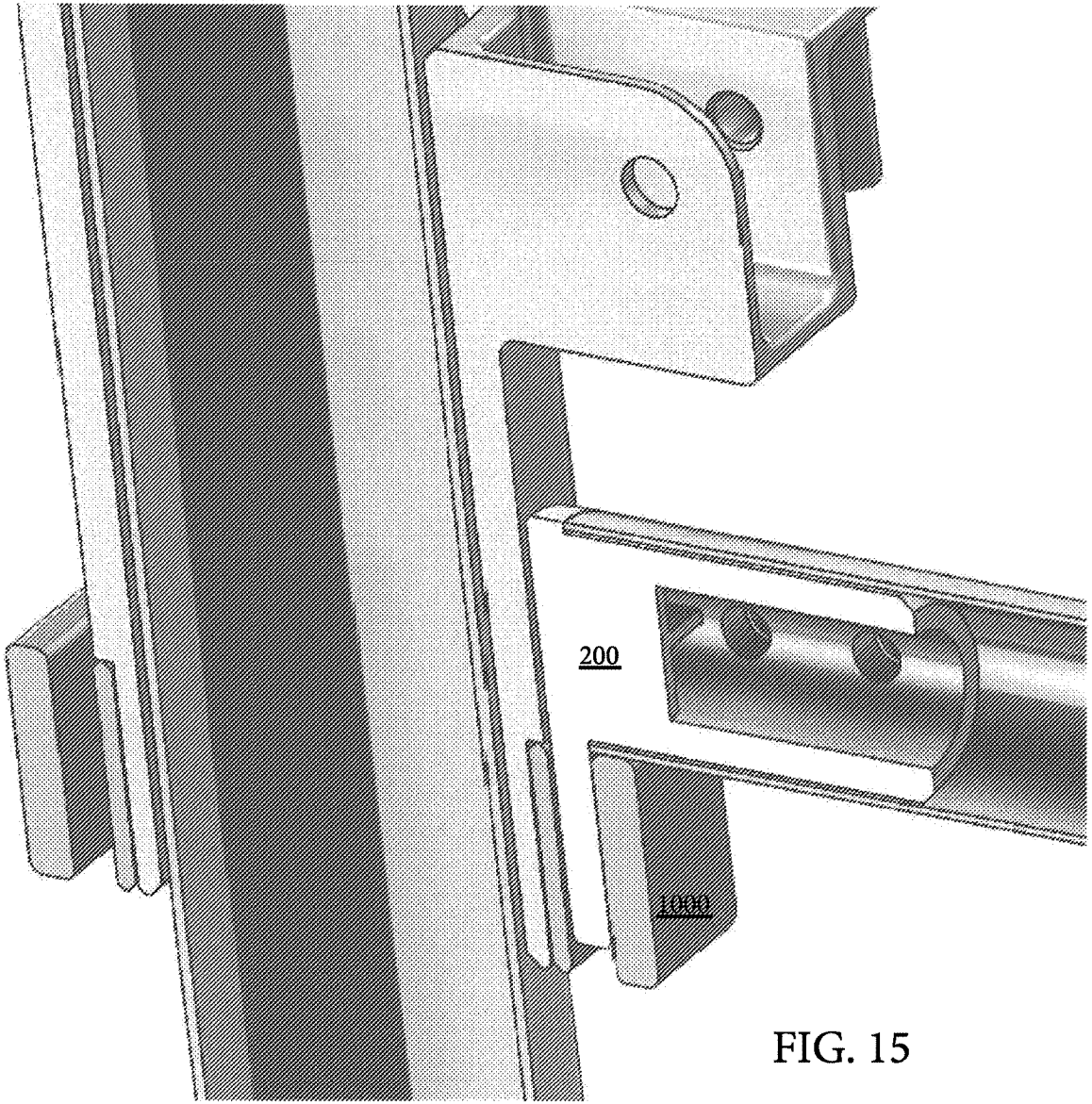
FIG. 15 is a cross section of the truss support slider and insertable accessory pole of FIG. 14.

FIGS. 14 through 15 illustrate the frame hub 1000. FIG. 15 is a cross section of the frame hub 1000 and insertable accessory pole 200 of FIG. 14.

Figure 16:
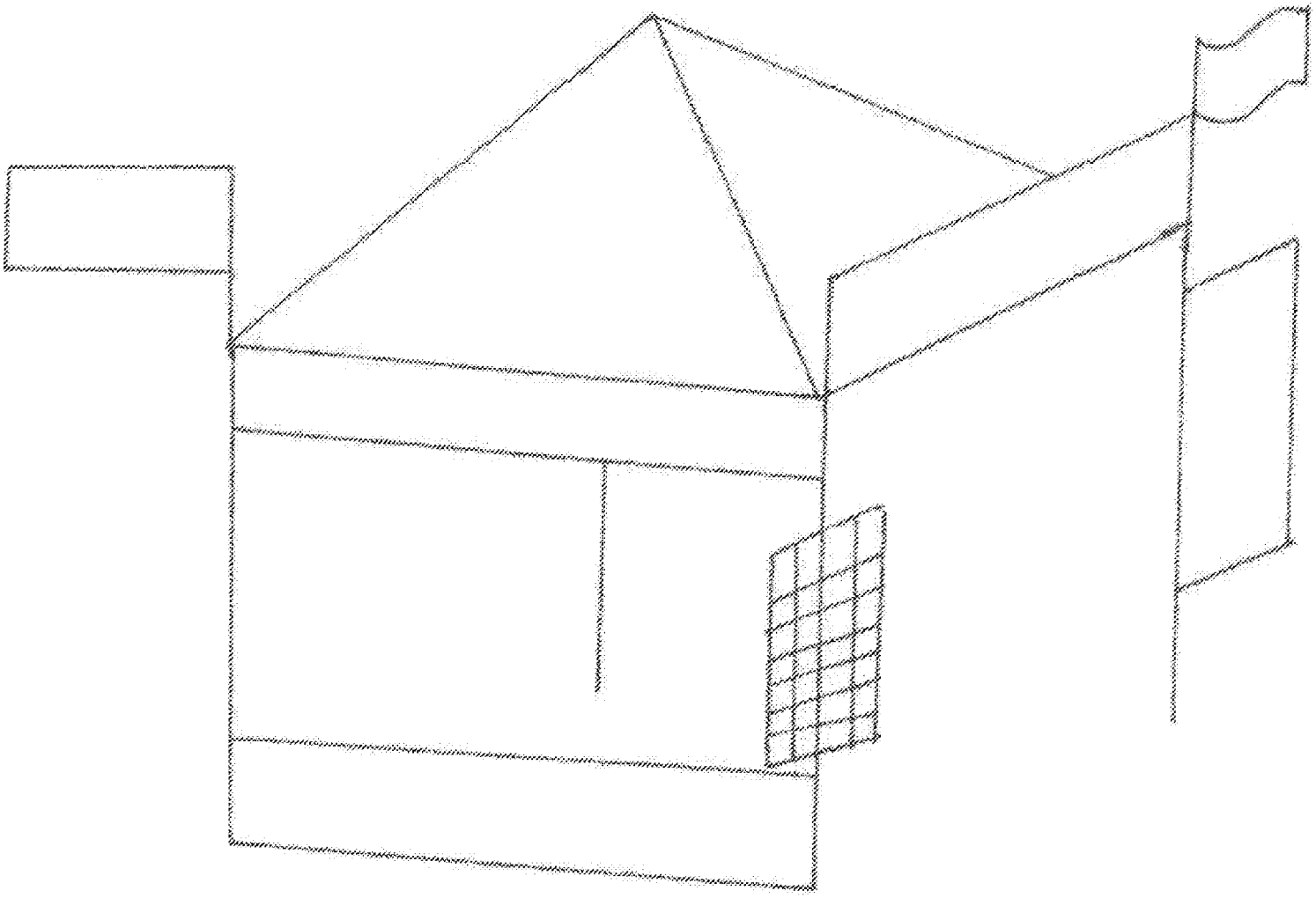
FIG. 16 is a perspective view of a canopy with various accessories installed on the framework via hubs.
Figure 17:
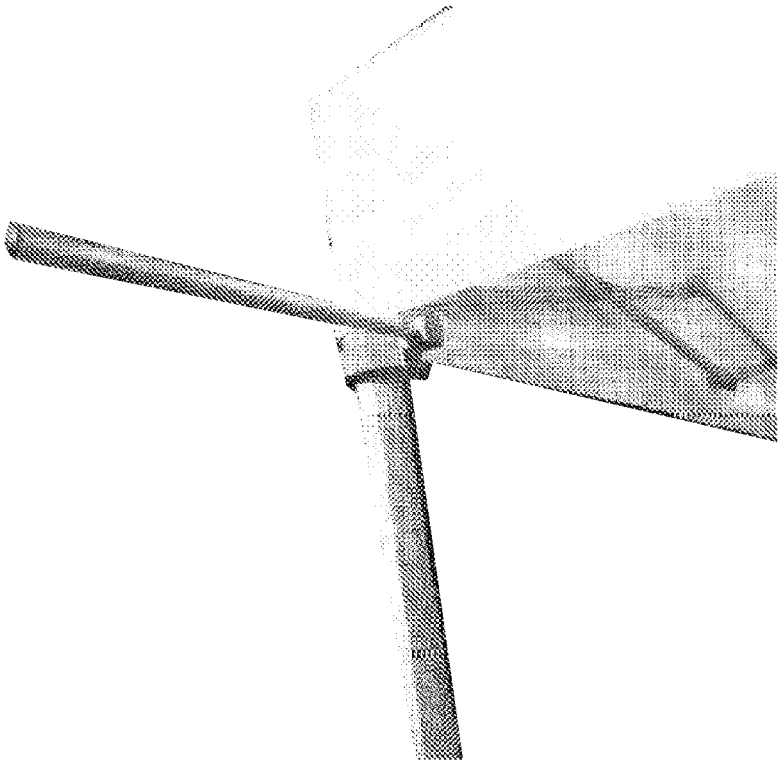
FIG. 17 is a perspective view of a canopy with various accessories installed on the framework via hubs.
Figure 18:
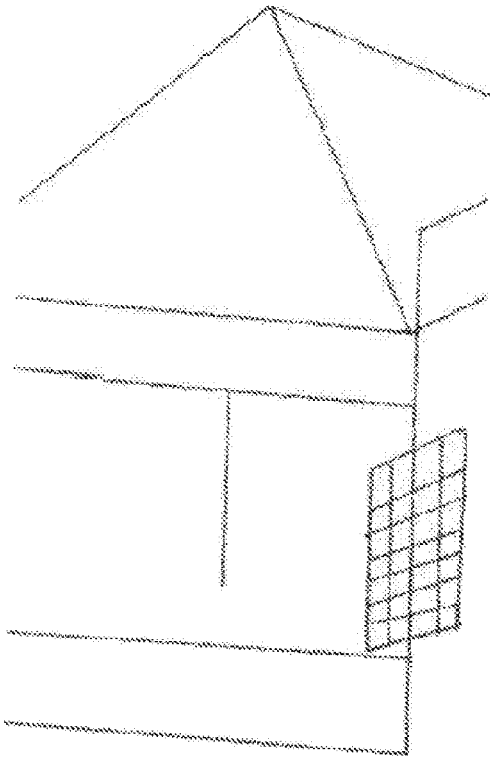
FIG. 18 is a view of a display assembly.
Figure 19:
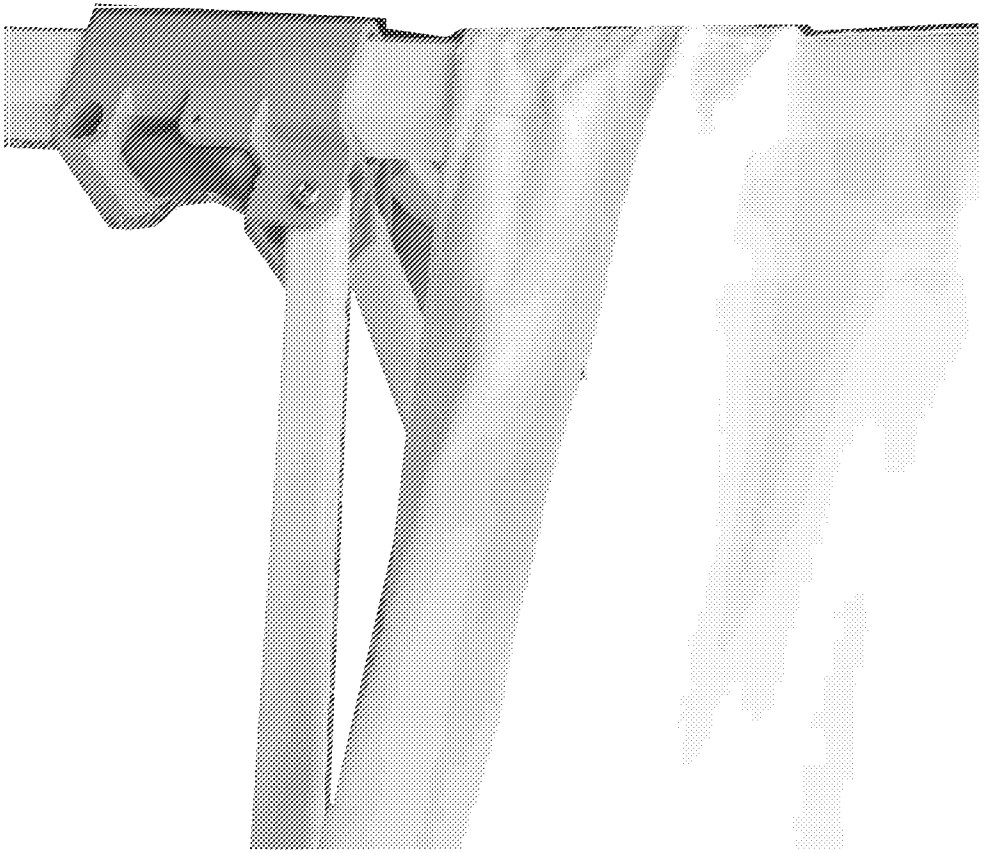
FIG. 19 is a perspective view of a prior art truss support slider.
Figure 20:
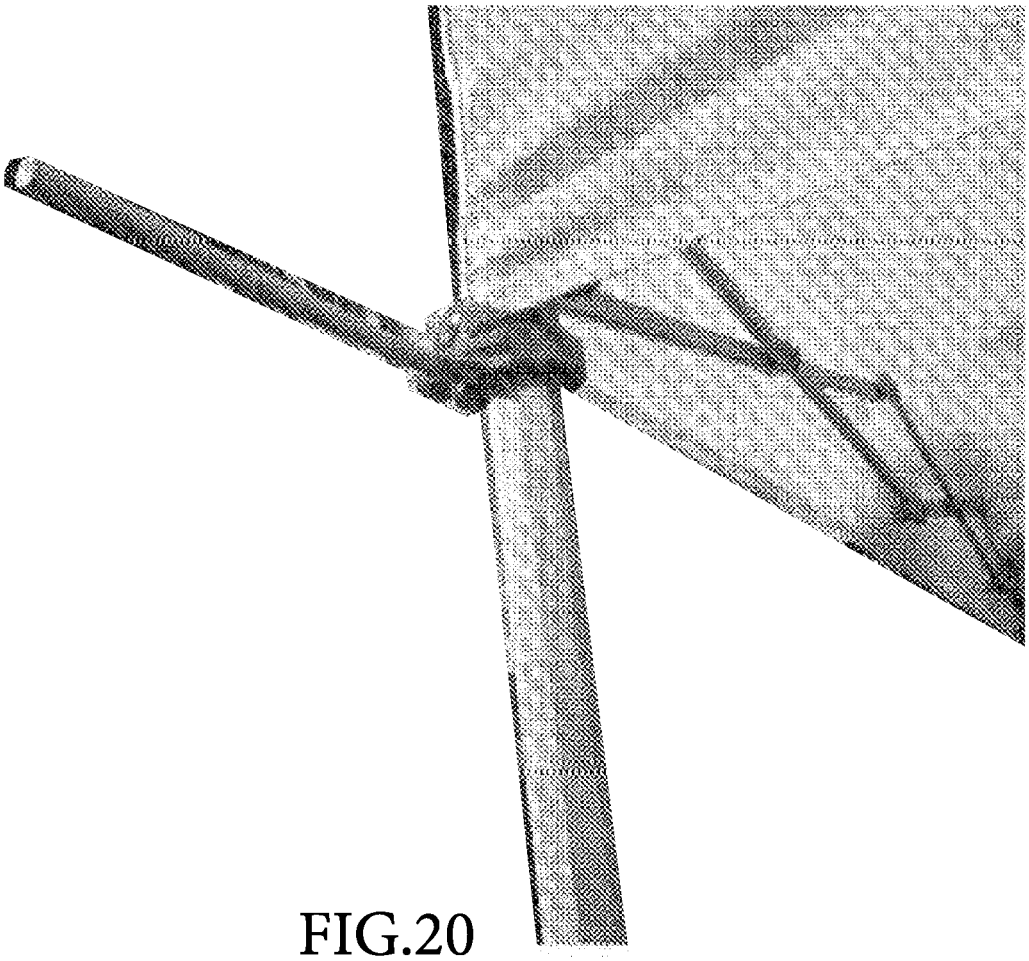
FIG. 20 is a perspective view of pole attachment accessory that is capable of connecting to a hub disclosed herein.
Figure 21:
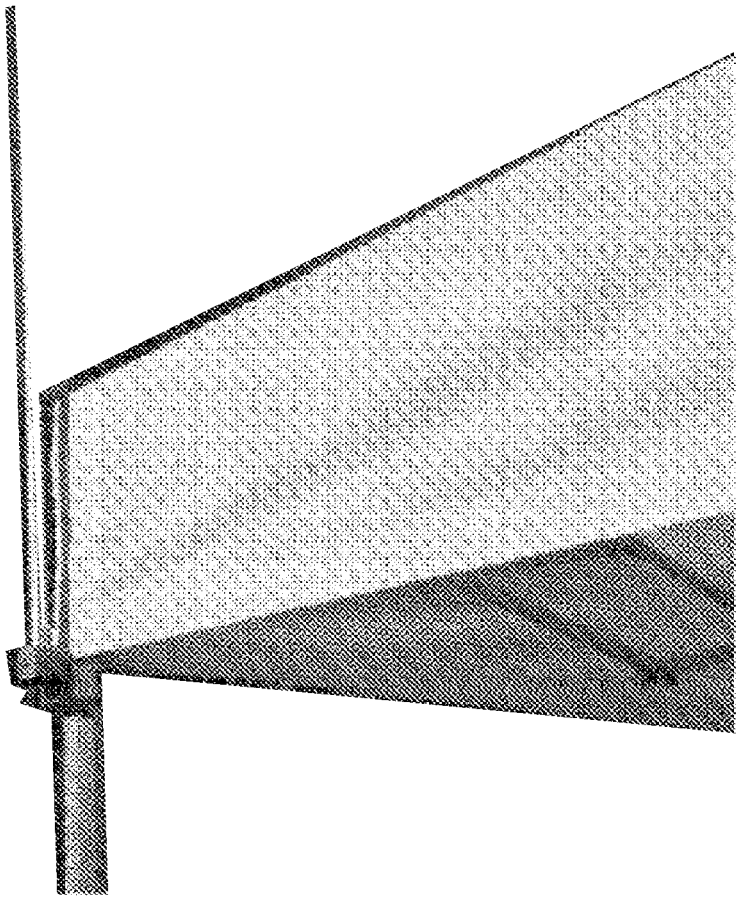
FIG. 21 is a perspective view of a canopy with various accessories installed on the framework via hubs.
Figure 22:
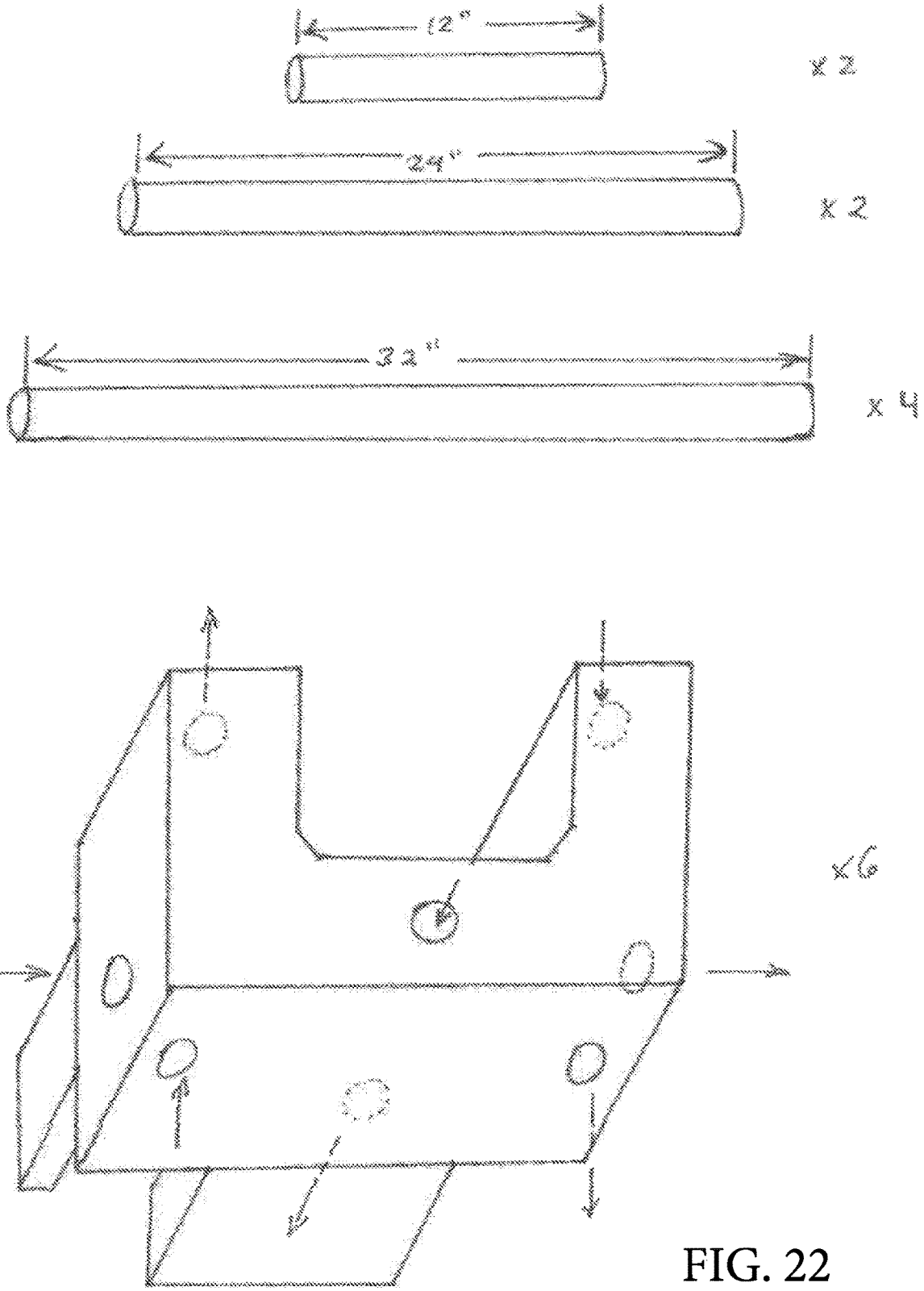
FIG. 22 is a perspective view of pole attachment accessory that is capable of connecting to a hub disclosed herein.
Figure 23:
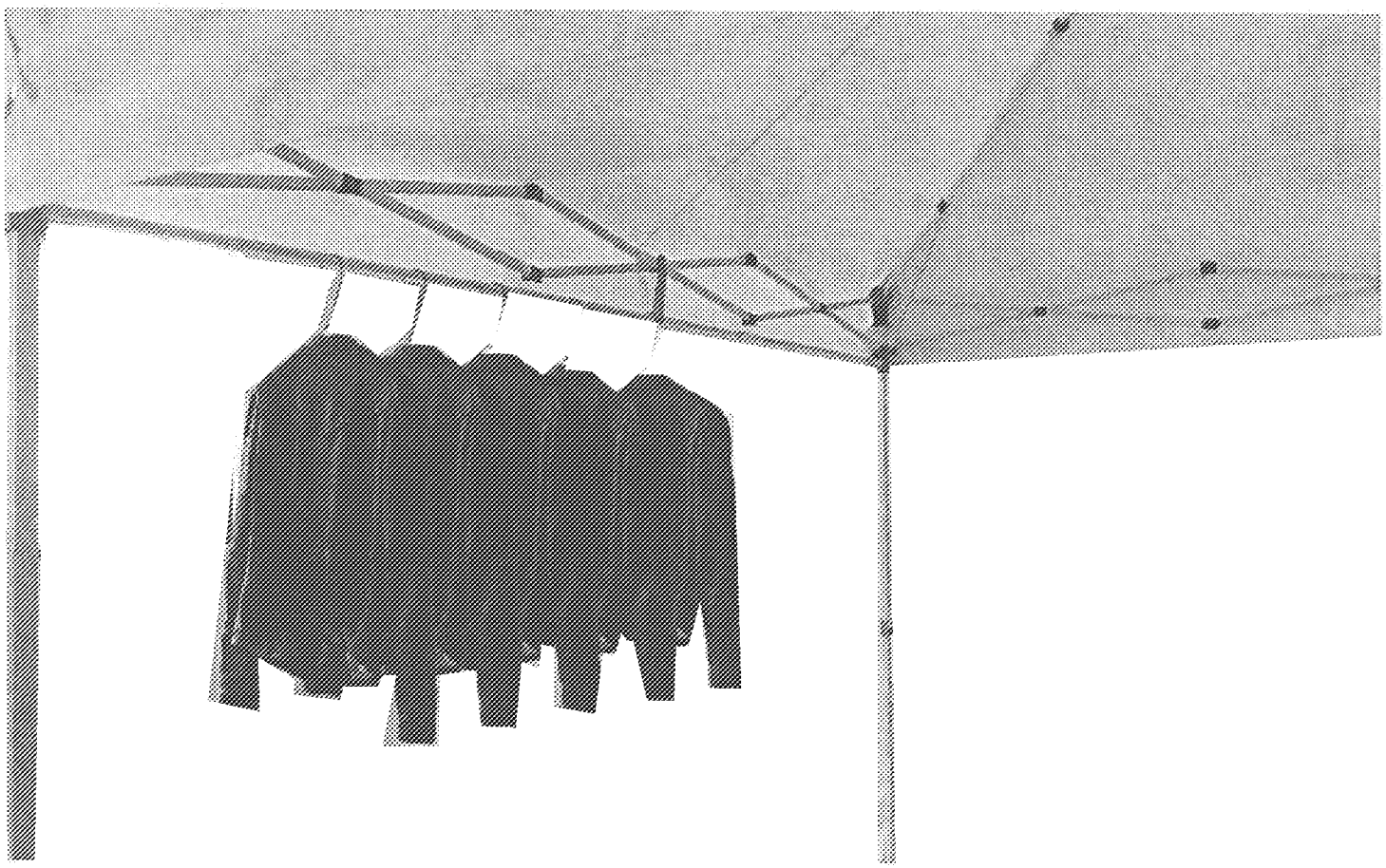
FIG. 23 is an environmental view of a canopy.

FIG. 16 is a perspective view of a canopy with various pole accessories installed on the framework via frame hubs 1000, where the poles support items such as signs or flags. FIG. 17 is a perspective view of a canopy with various accessories installed on the framework via hubs. FIG. 18 is a view of a display assembly using pole accessories. These attachments contrast with the prior art, as shown in FIG. 19, which is a perspective view of a prior art truss support slider that can accept a dowel in a hole. Other types of pole accessories are also contemplated. For instance, FIG. 20 is a perspective view of another type of pole attachment accessory that is capable of connecting to a hub disclosed herein. FIG. 21 is a perspective view of a canopy with various accessories to make a fence or border around the framework is installed on the framework via hubs. FIG. 22 is a perspective view of pole attachment accessory that is capable of connecting to a hub disclosed herein. The pole accessories can be strung between two legs 2000 to accomplish a hanging rod or a rail skirt, e.g., as shown in FIG. 23, which is an environmental view of a canopy.

Figure 24:
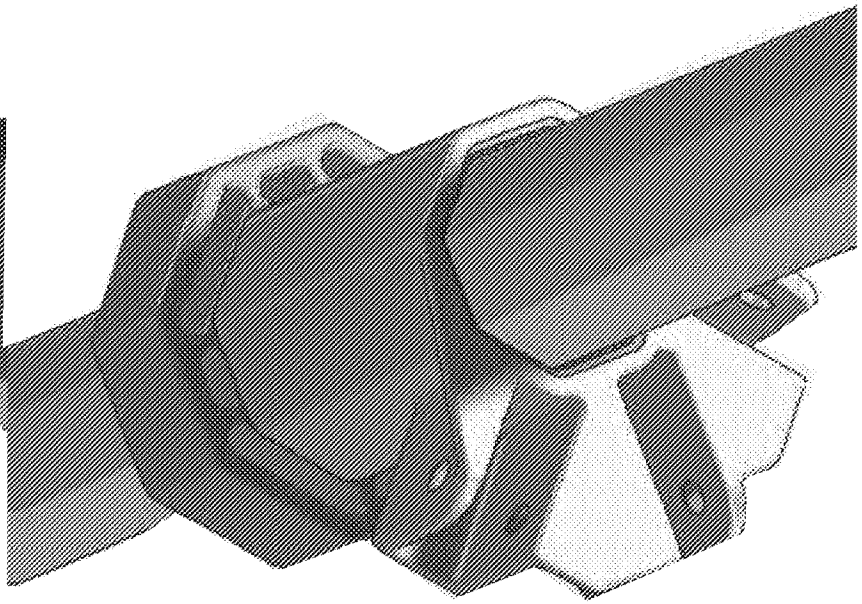
FIG. 24 is an environmental view of a hub provided to a truss support slider.
Figure 25:
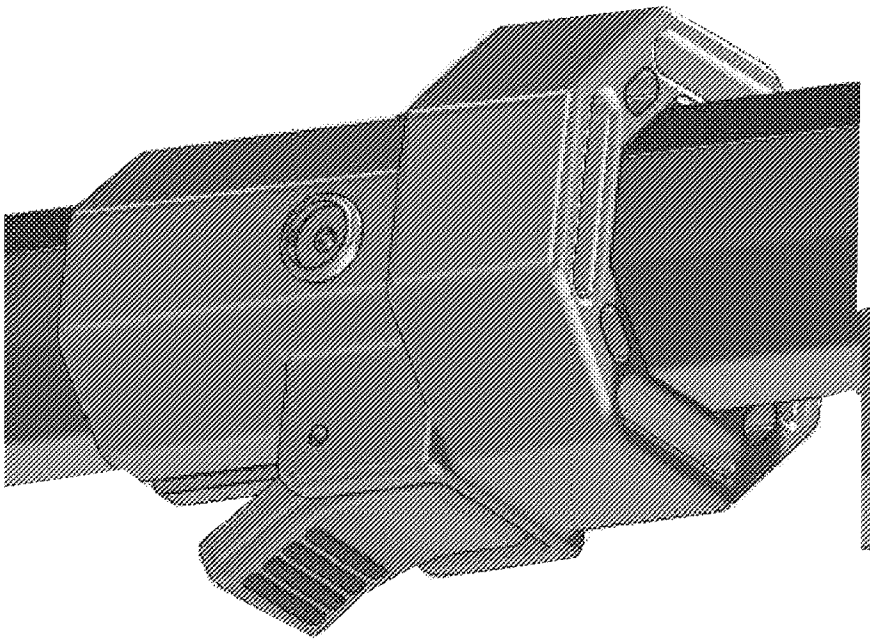
FIG. 25 is an environmental view of a hub provided to a leg adjustment hub.
Figure 26:
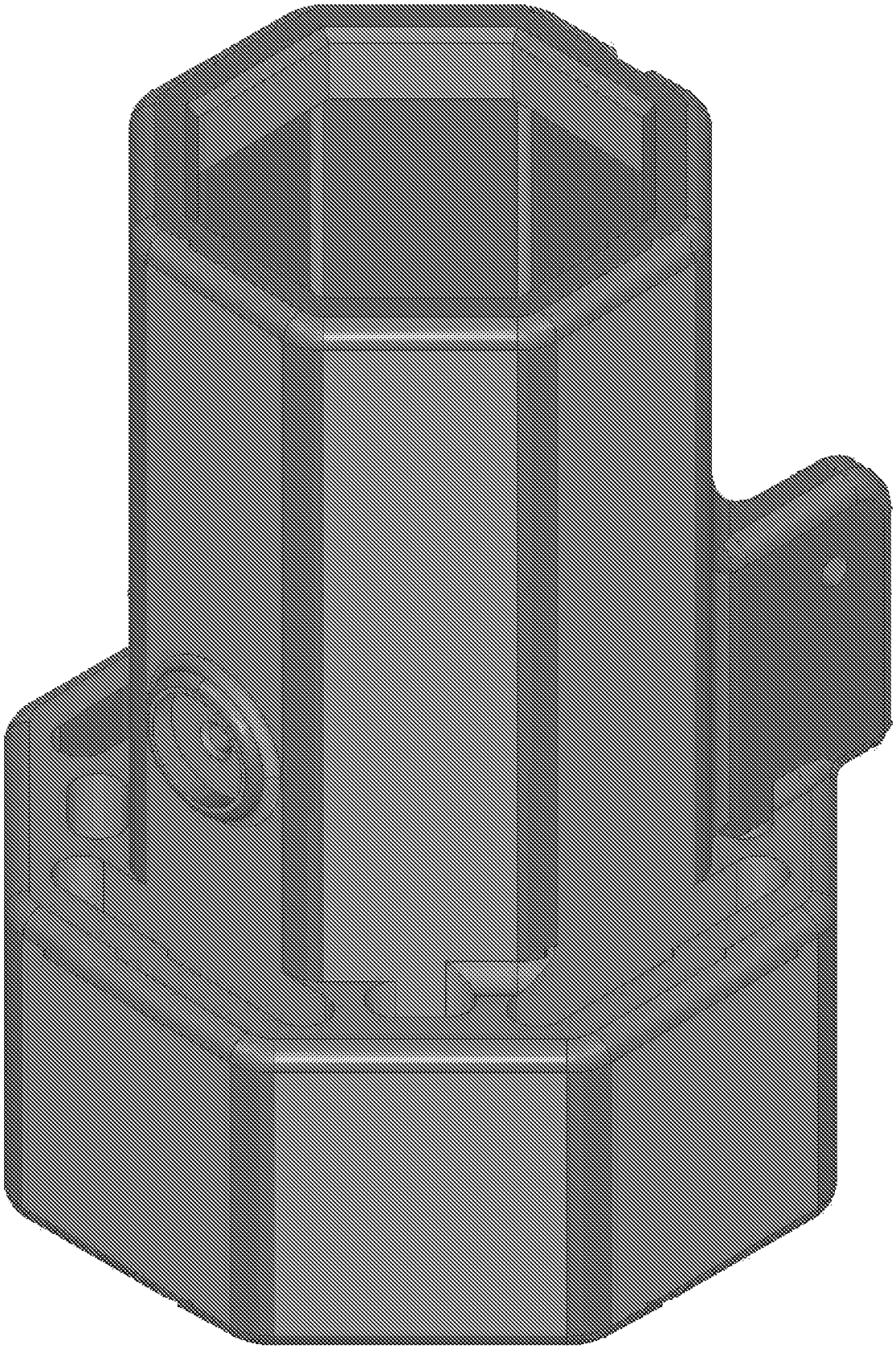
FIG. 26 is perspective view of the hub of FIG. 25.
Figure 27:
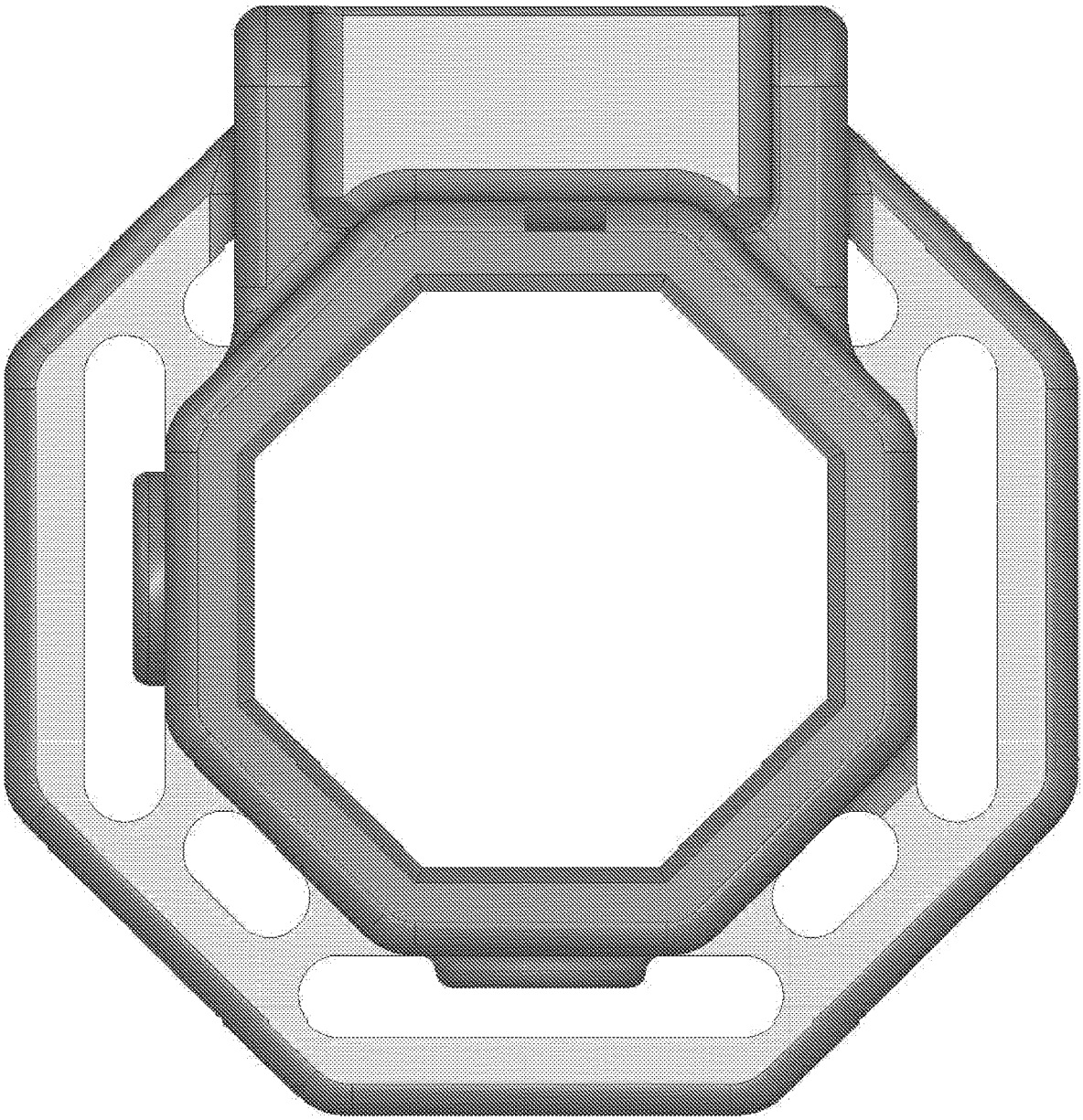
FIG. 27 is top view of the hub of FIG. 25.
Figure 28:
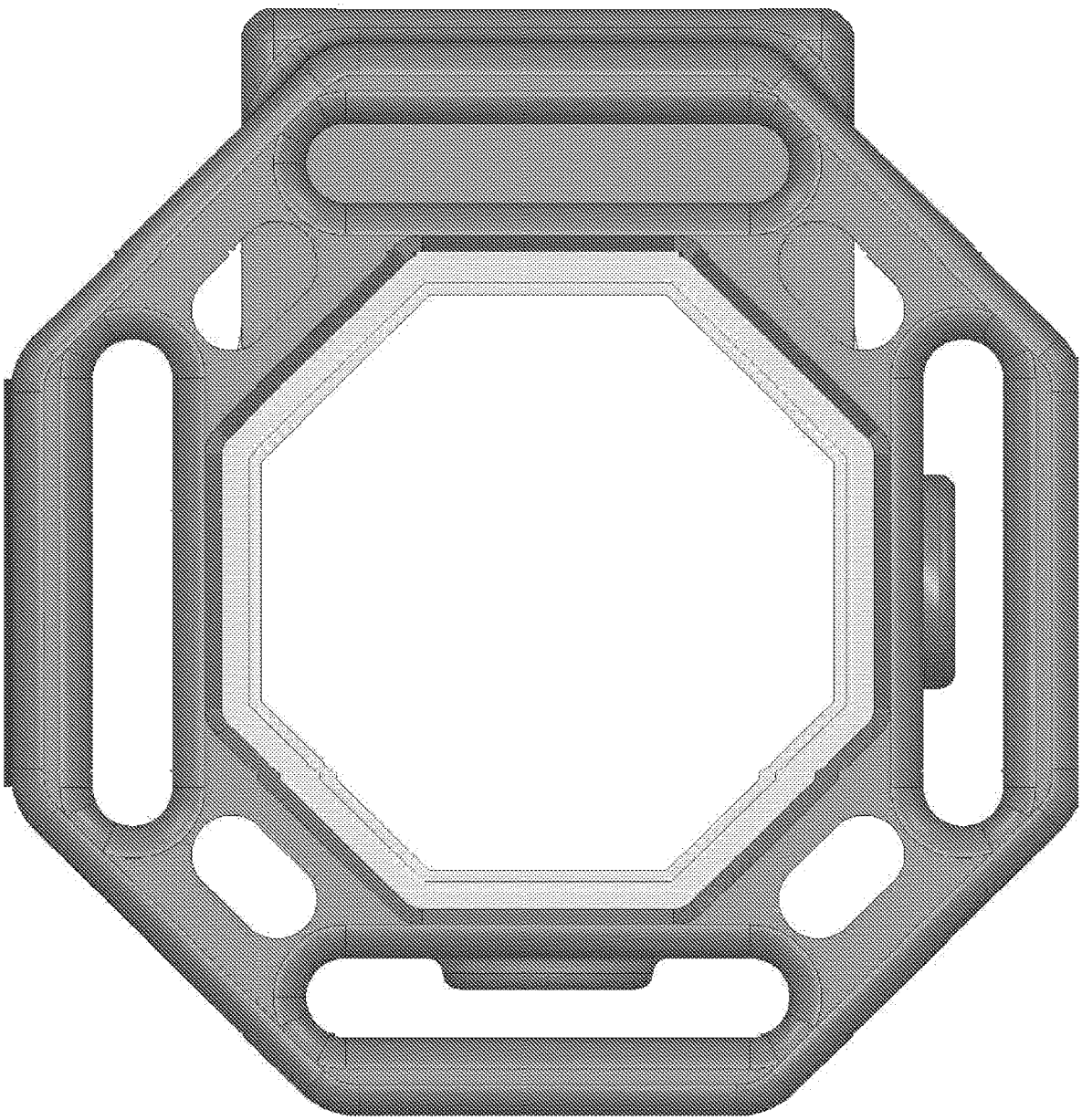
FIG. 28 is a bottom view of the hub of FIG. 25.
Figure 29:
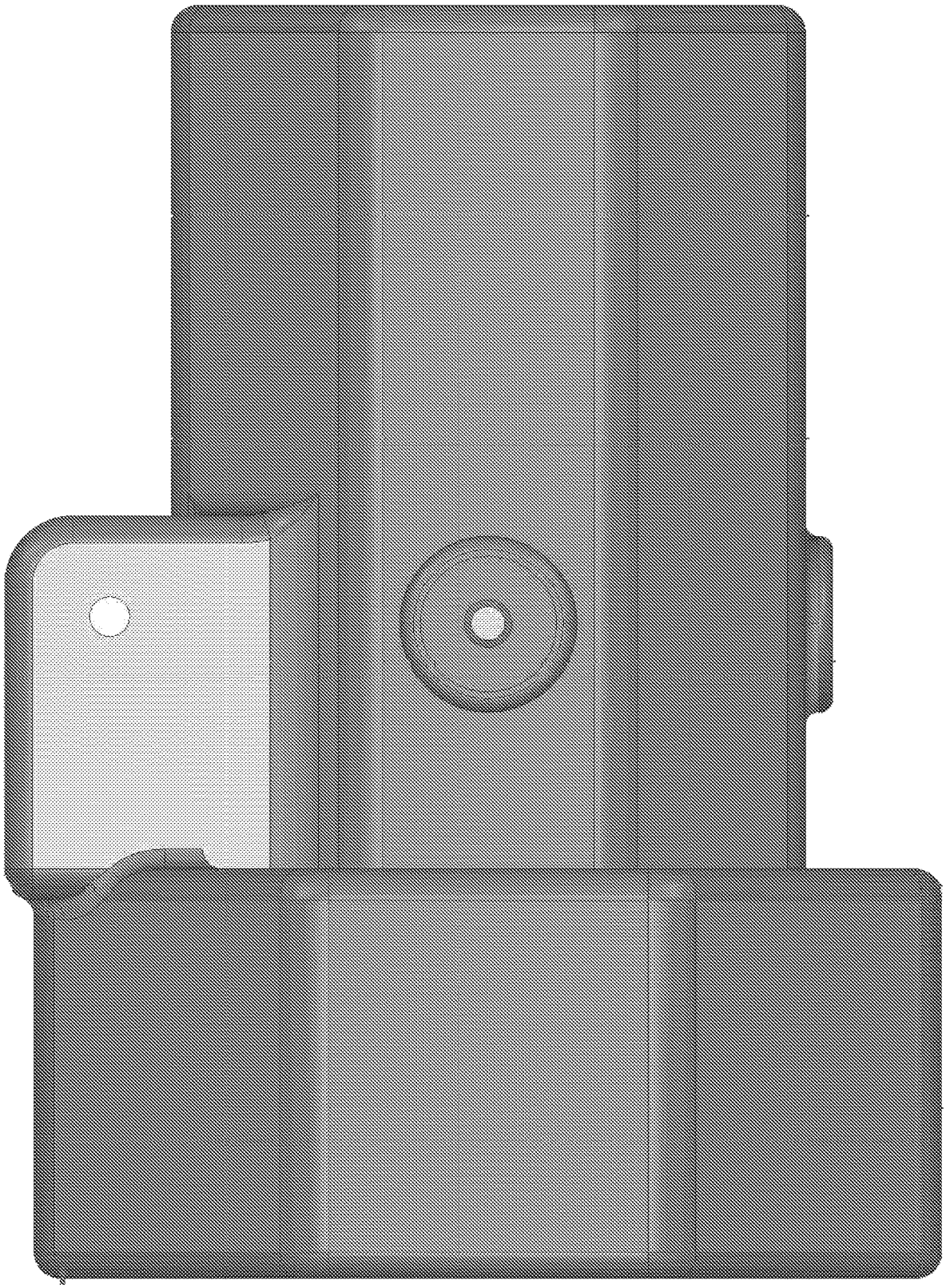
FIG. 29 is a left-side view of the hub of FIG. 25.
Figure 30:
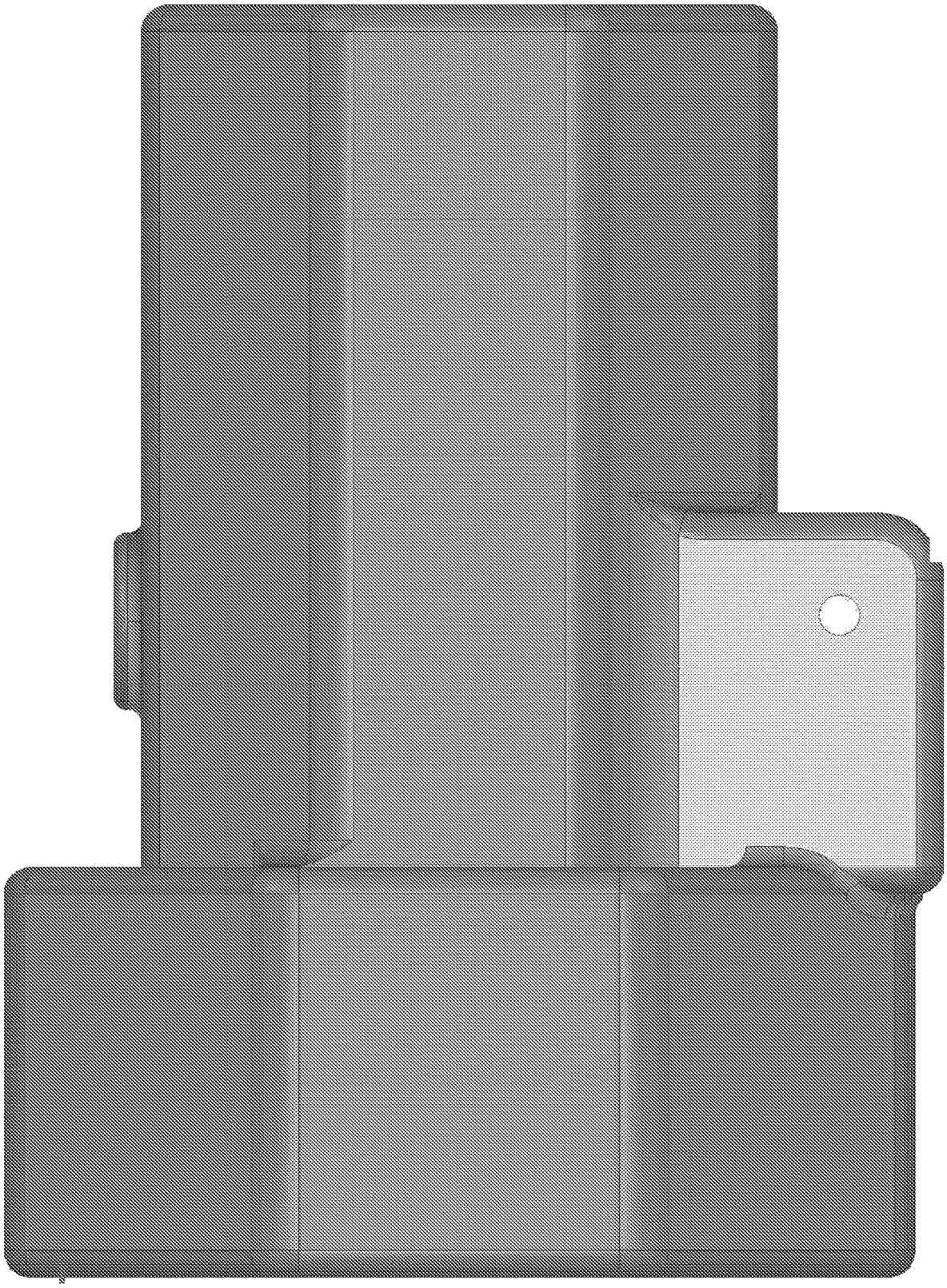
FIG. 30 is a right side view of the hub of FIG. 25.
Figure 31:
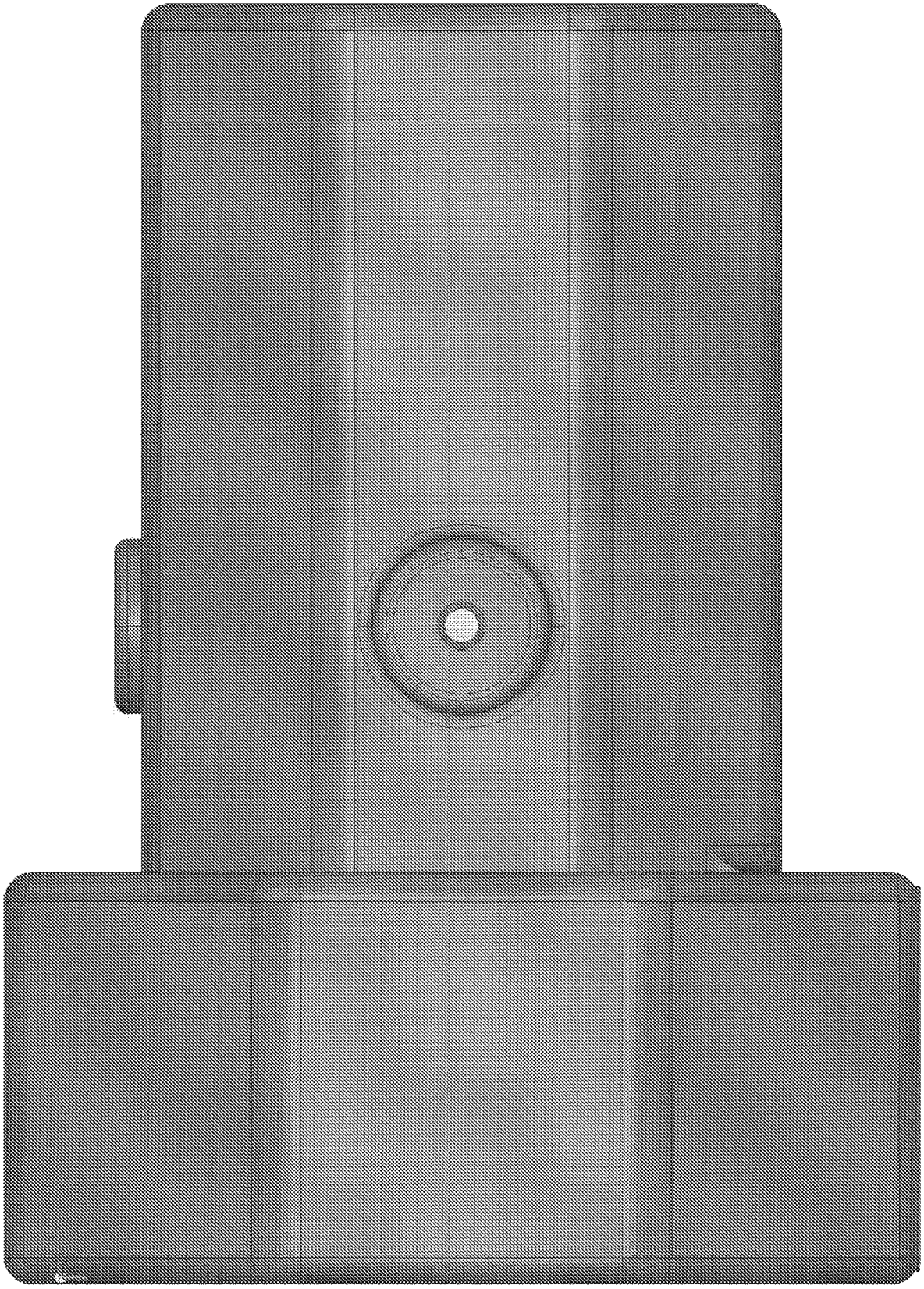
FIG. 31 is a back view of the hub of FIG. 25.
Figure 32:
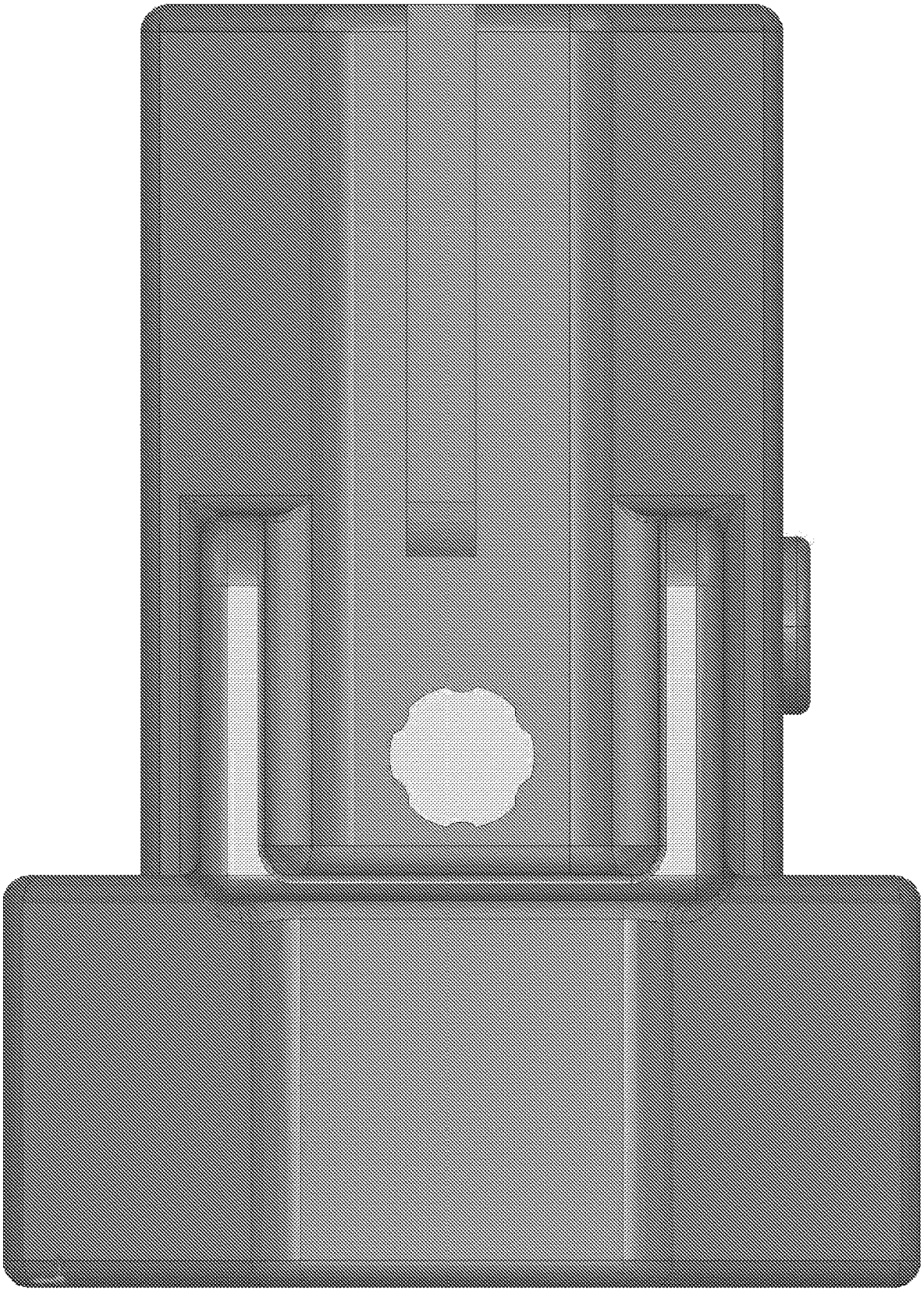
FIG. 32 is a front view of the hub of FIG. 25.
Figure 33:
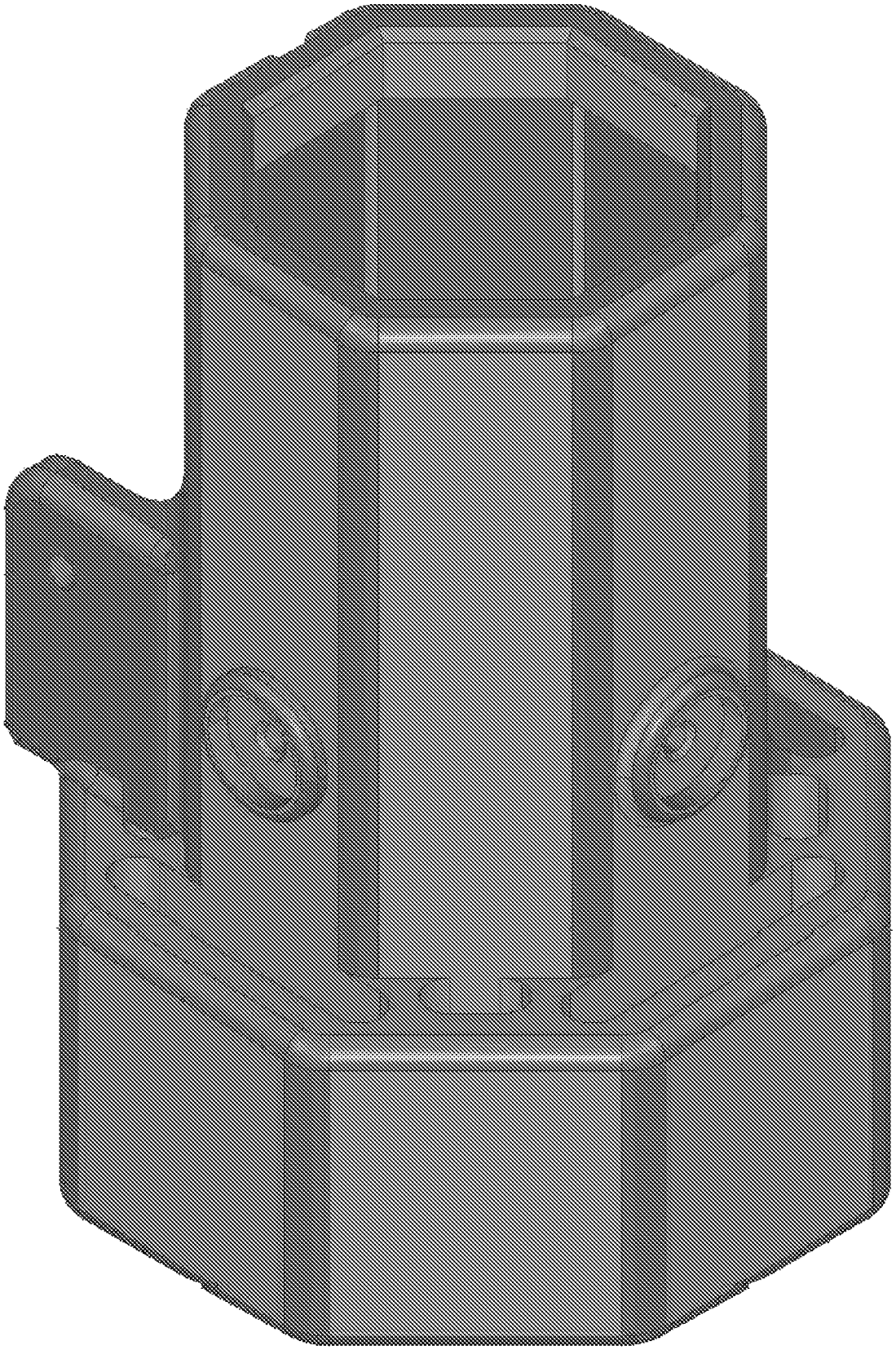
FIG. 33 is a perspective view of the hub of FIG. 25.
Figure 34:
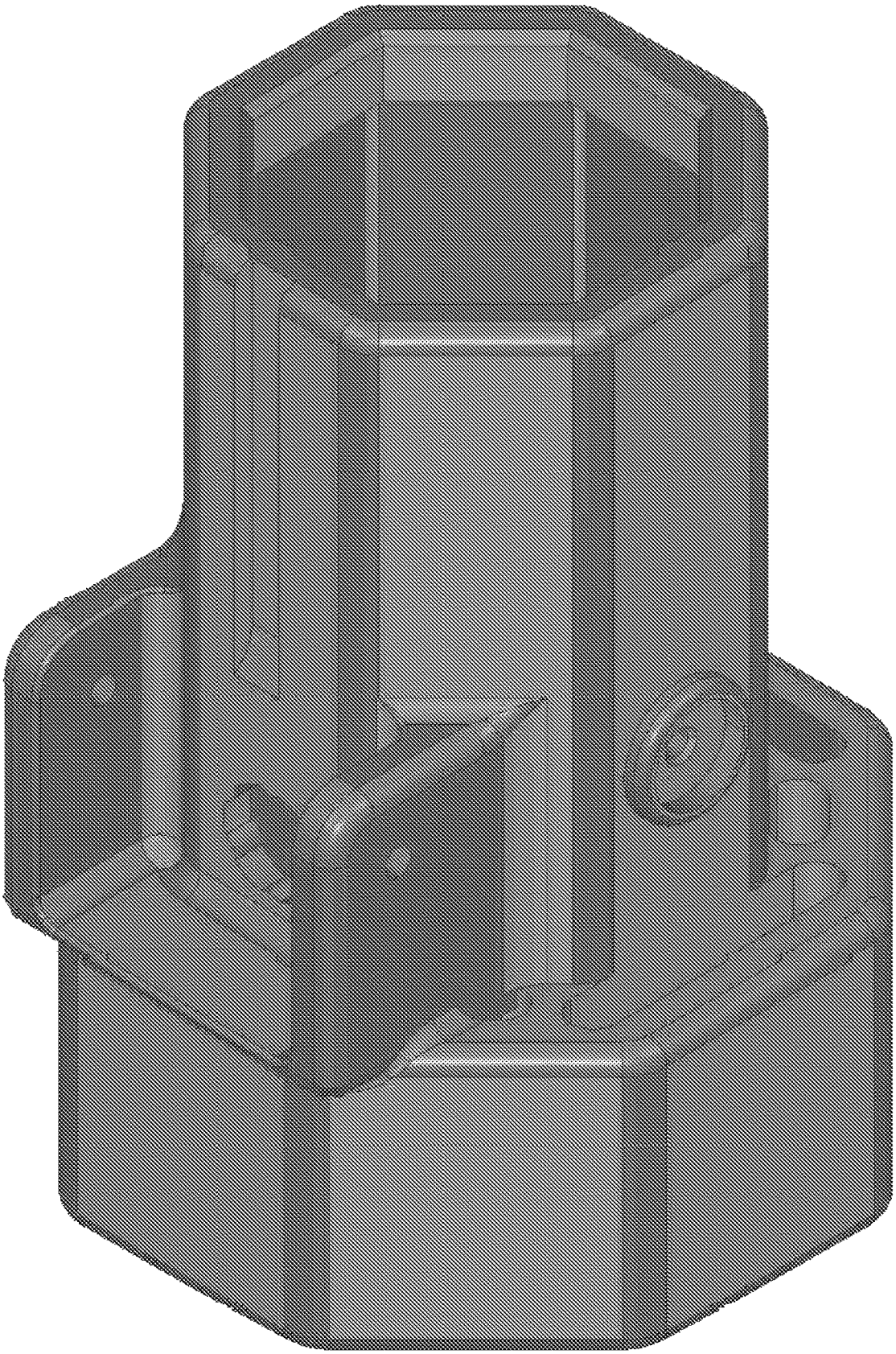
FIG. 34 is a perspective view of the hub of FIG. 25.
Figure 35:
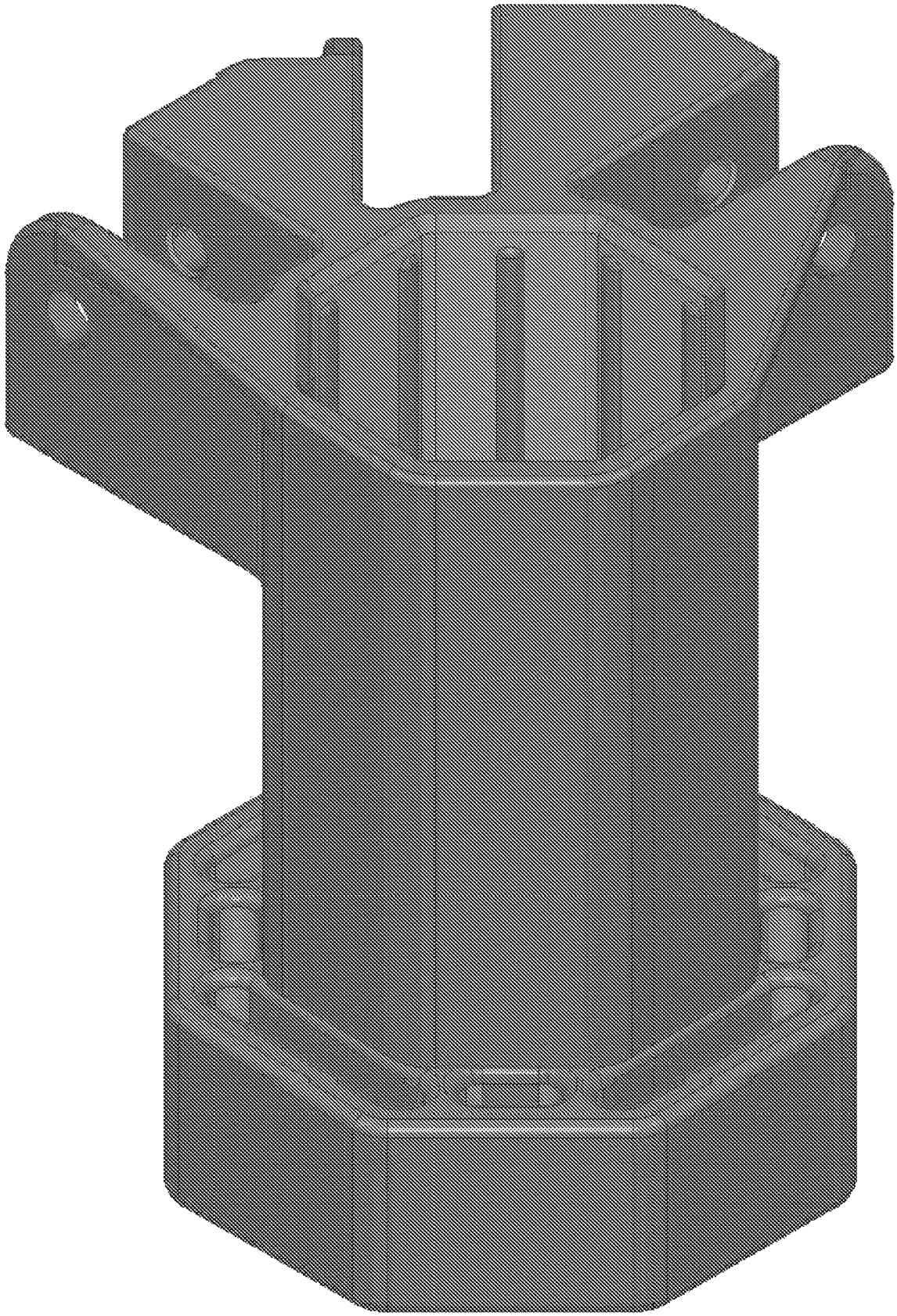
FIG. 35 is a perspective view of the hub of FIG. 24.
Figure 36:
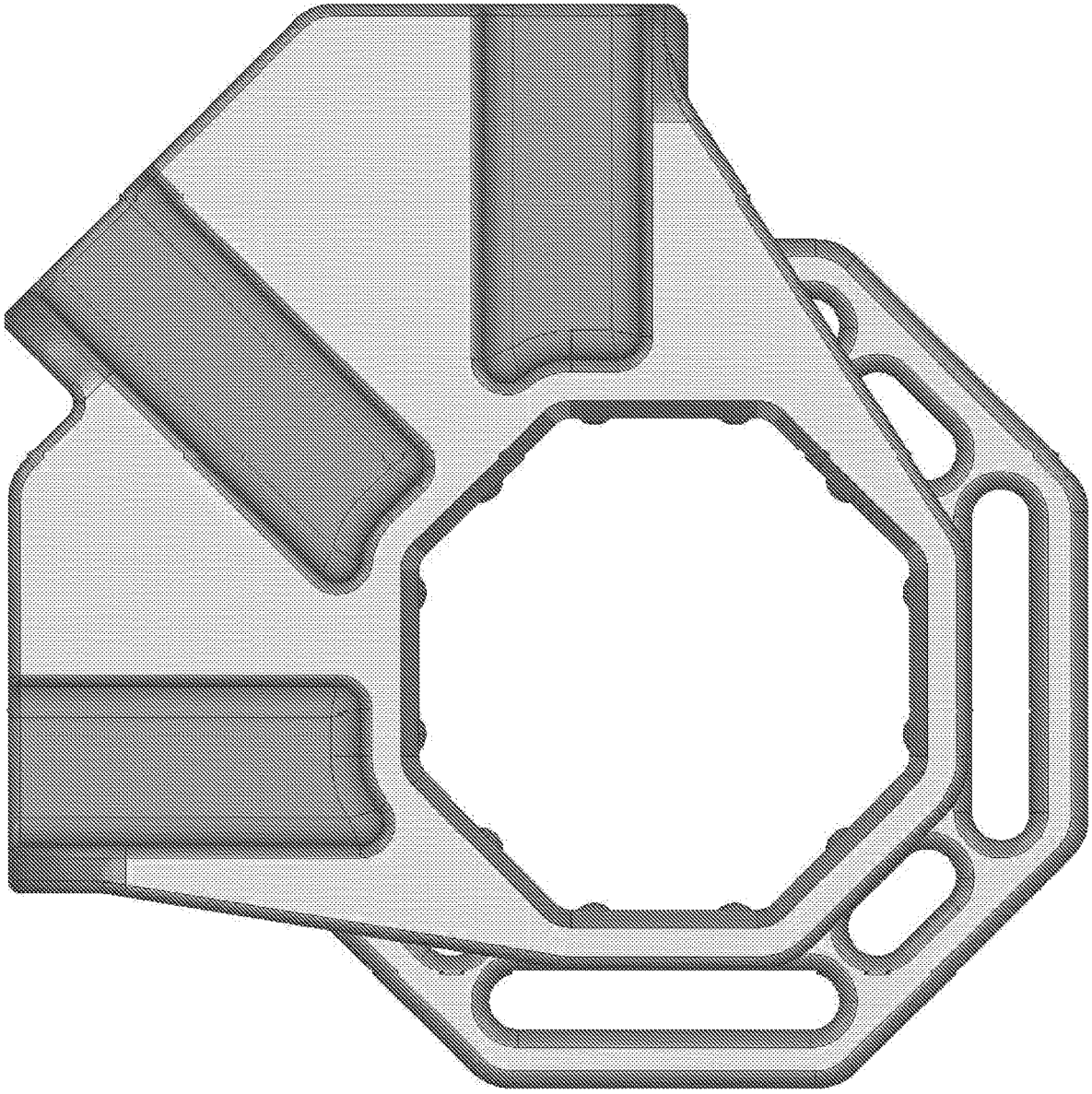
FIG. 36 is a top view of the hub of FIG. 24.
Figure 37:
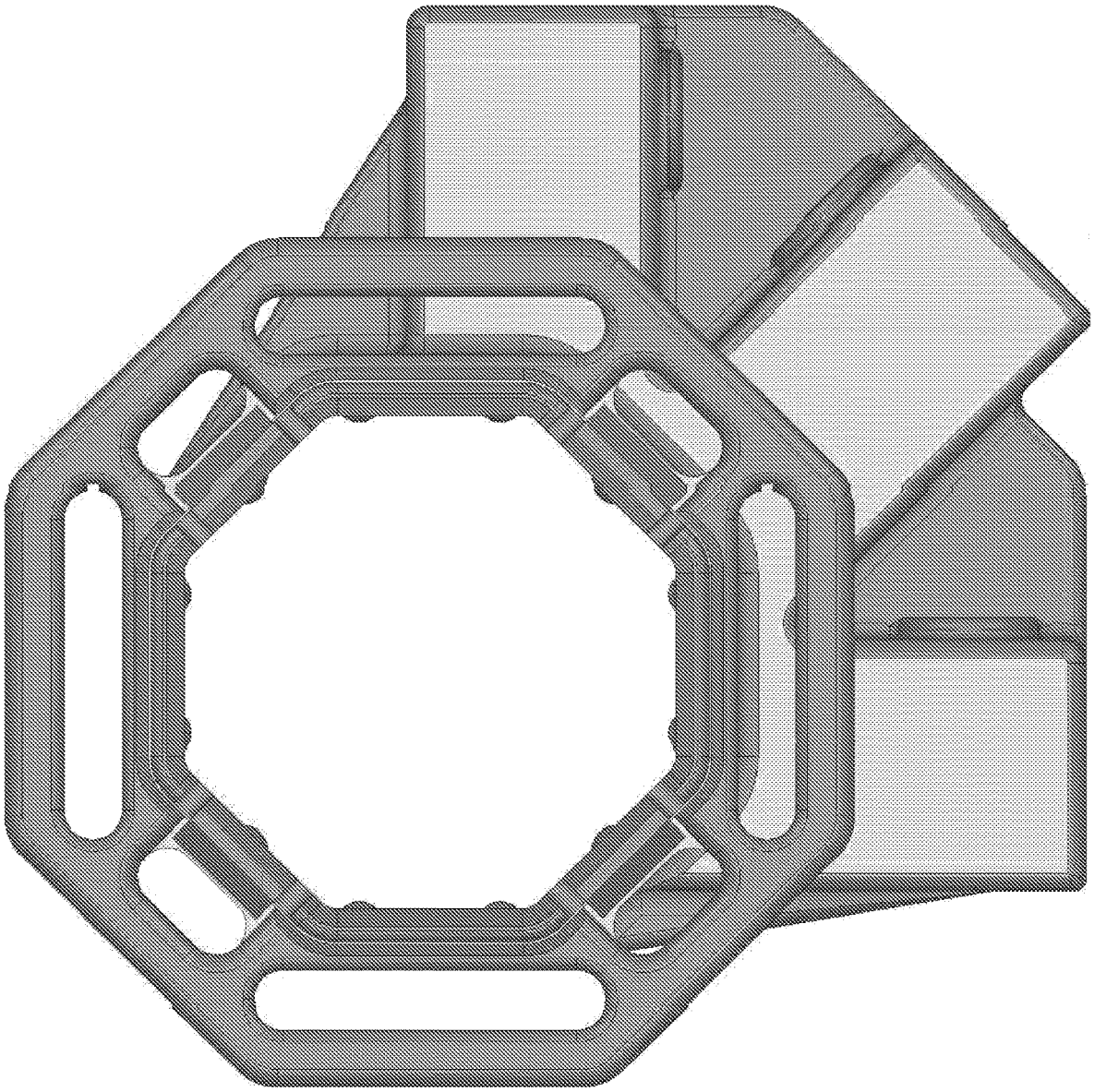
FIG. 37 is a bottom view of the hub of FIG. 24.
Figure 38:
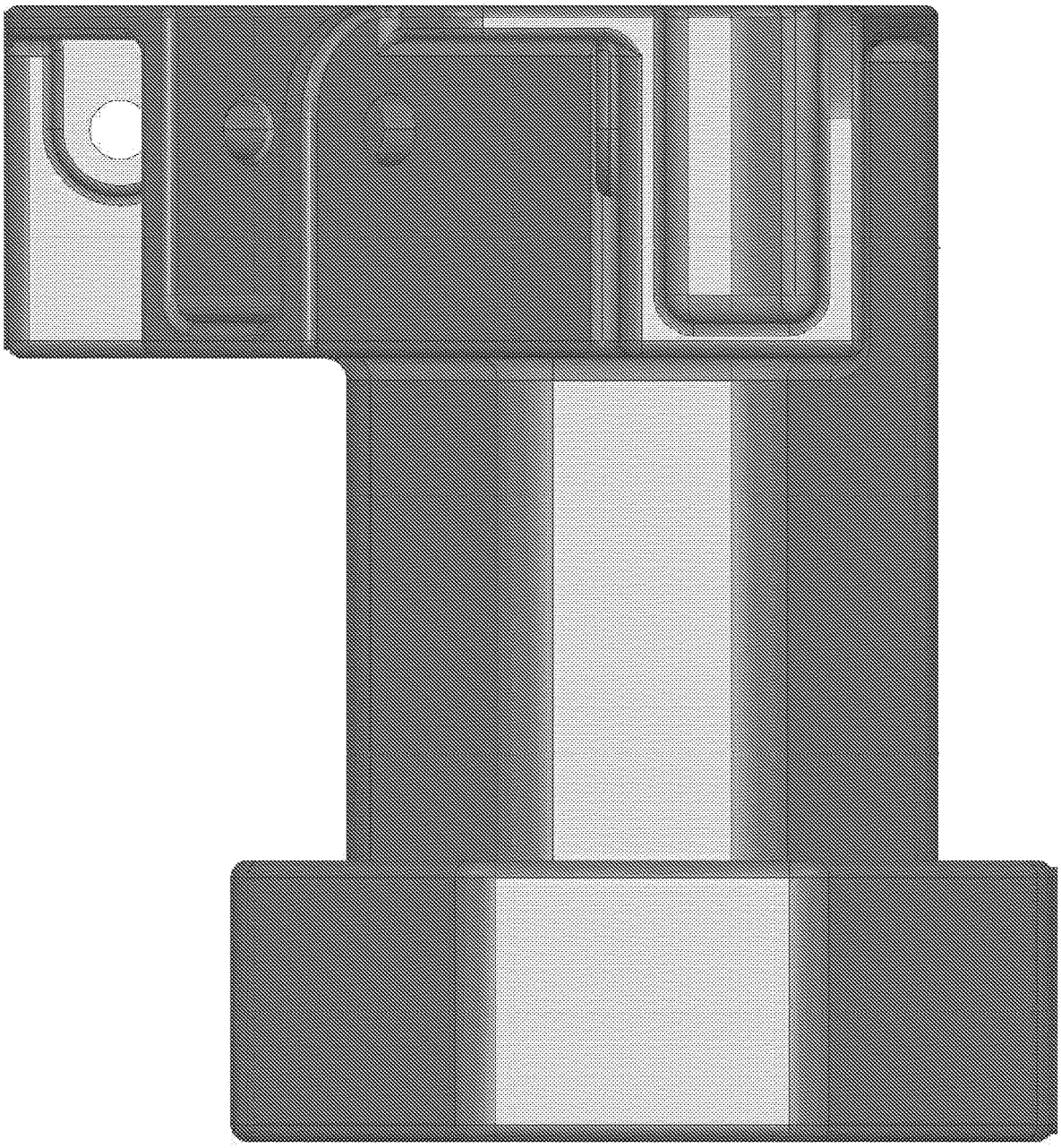
FIG. 38 is a left-side view of the hub of FIG. 24.
Figure 39:
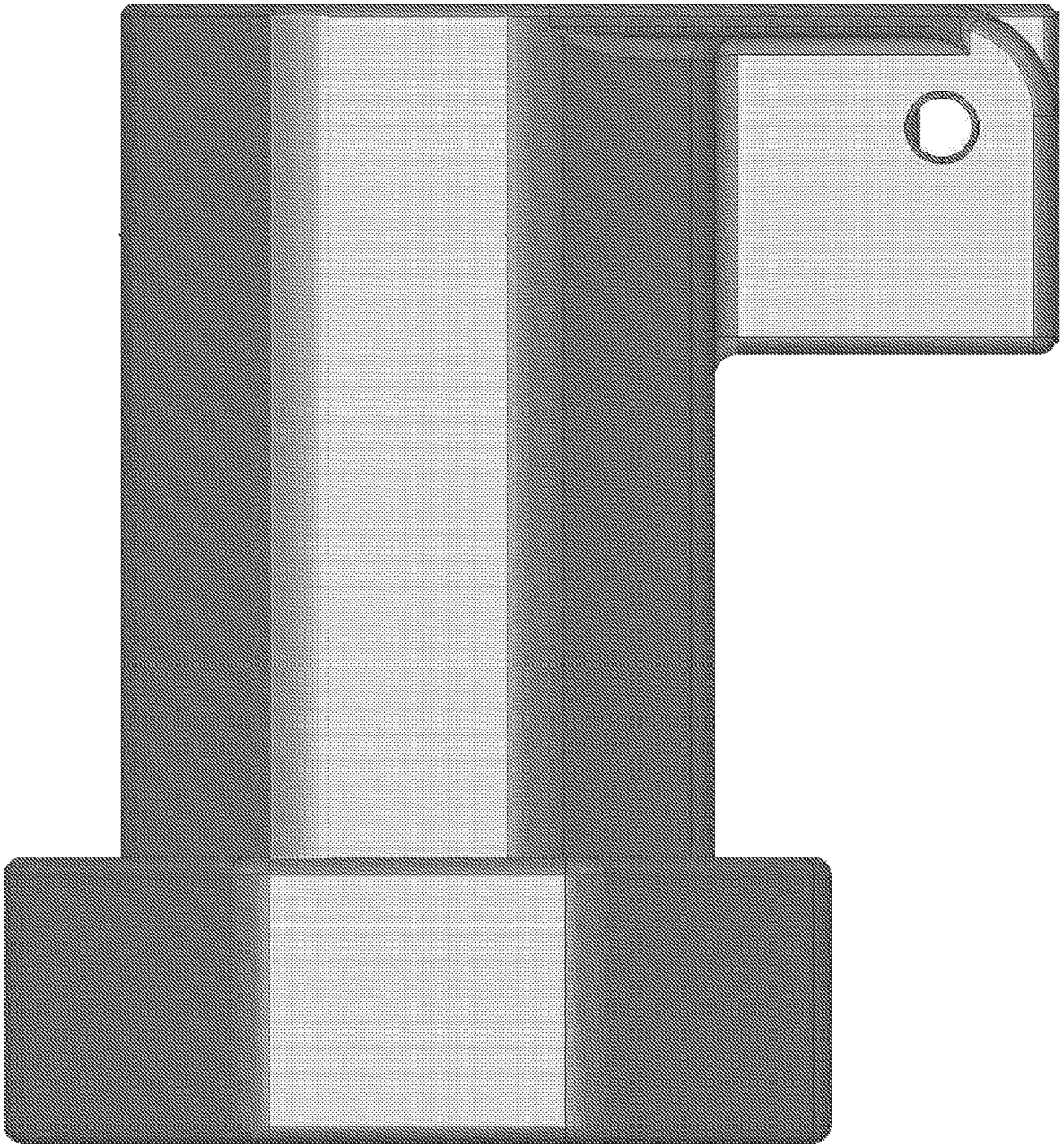
FIG. 39 is a right side view of the hub of FIG. 24.
Figure 40:
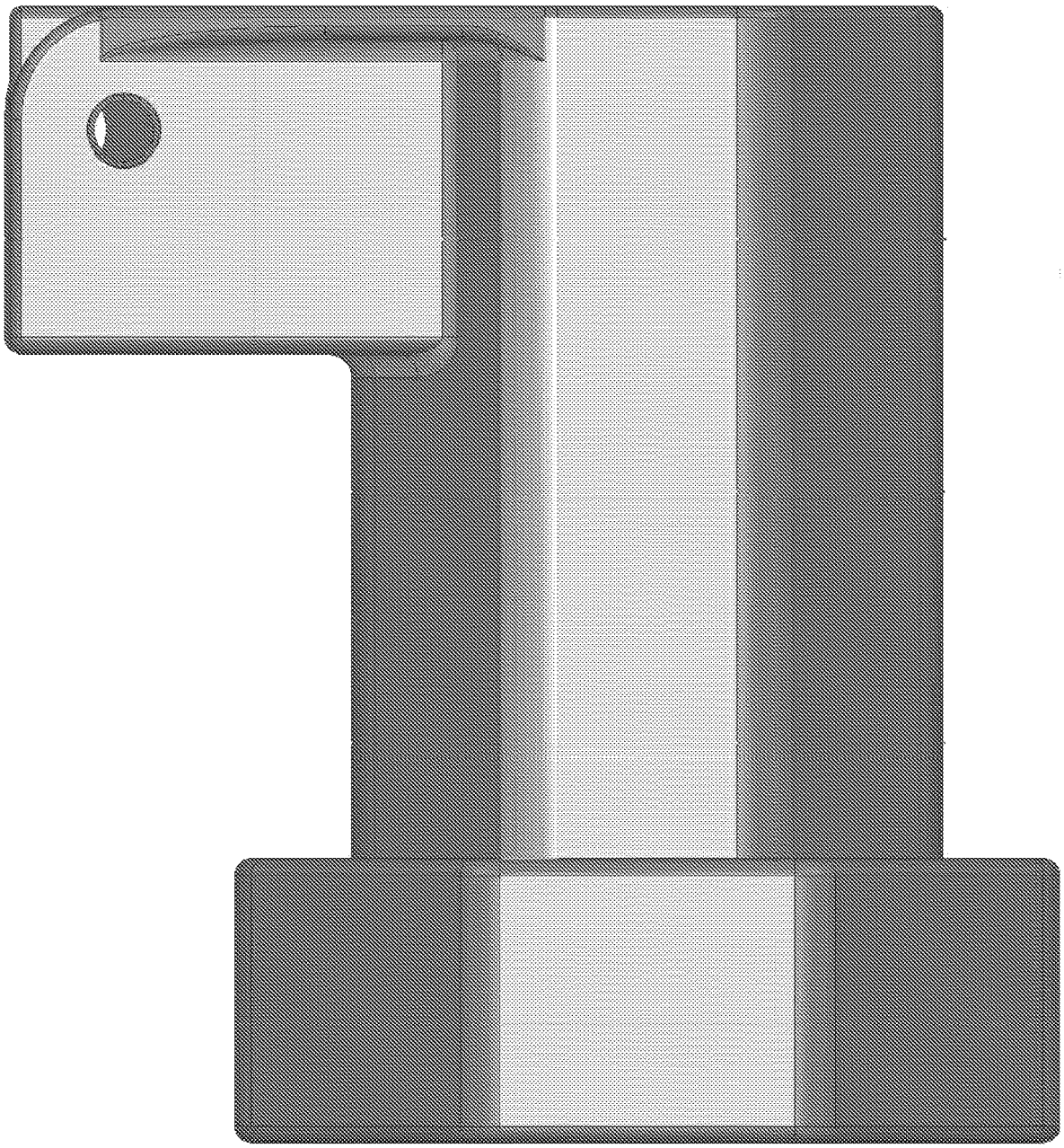
FIG. 40 is a back view of the hub of FIG. 24.
Figure 41:
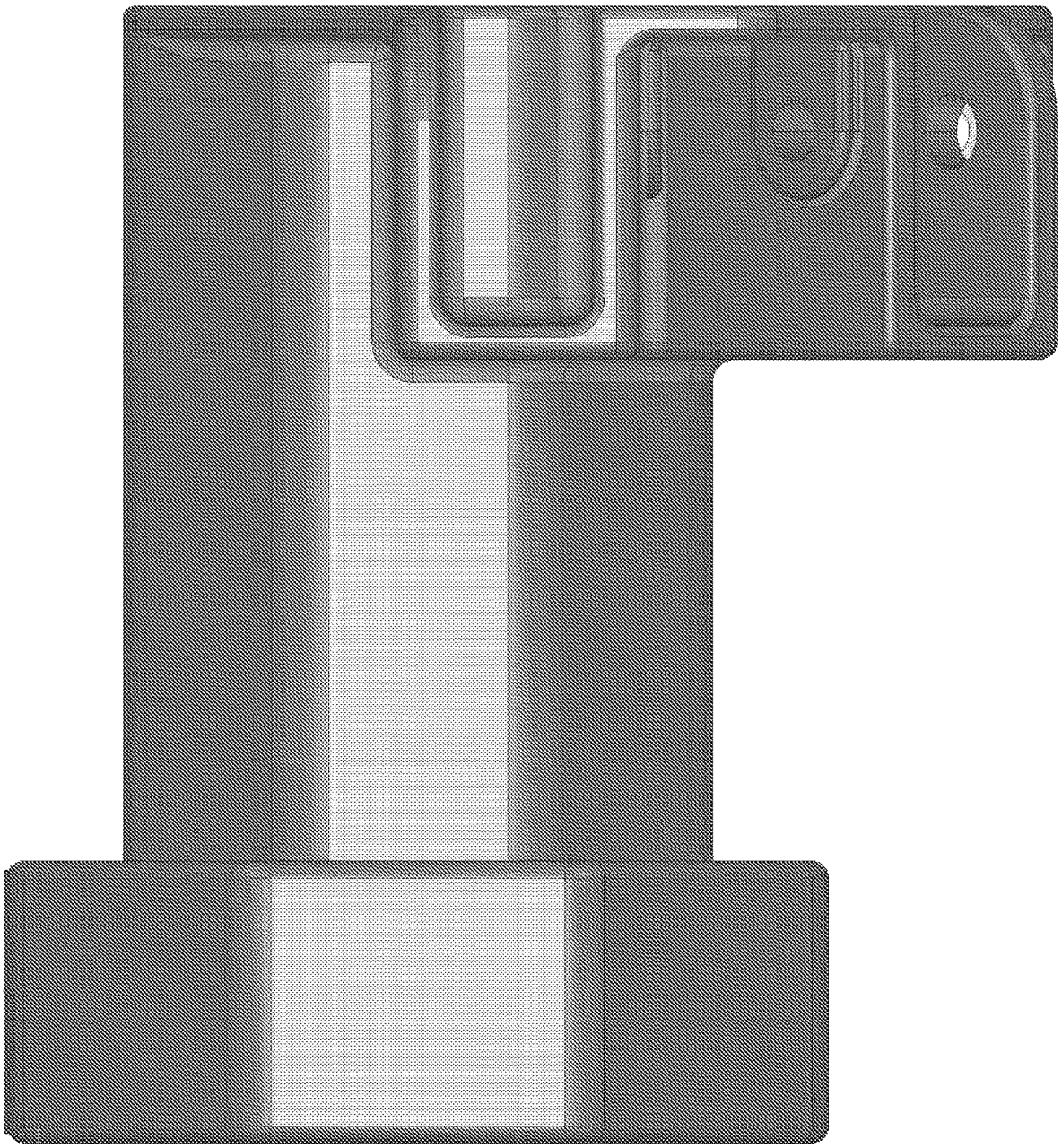
FIG. 41 is a front view of the hub of FIG. 24.
Figure 42:
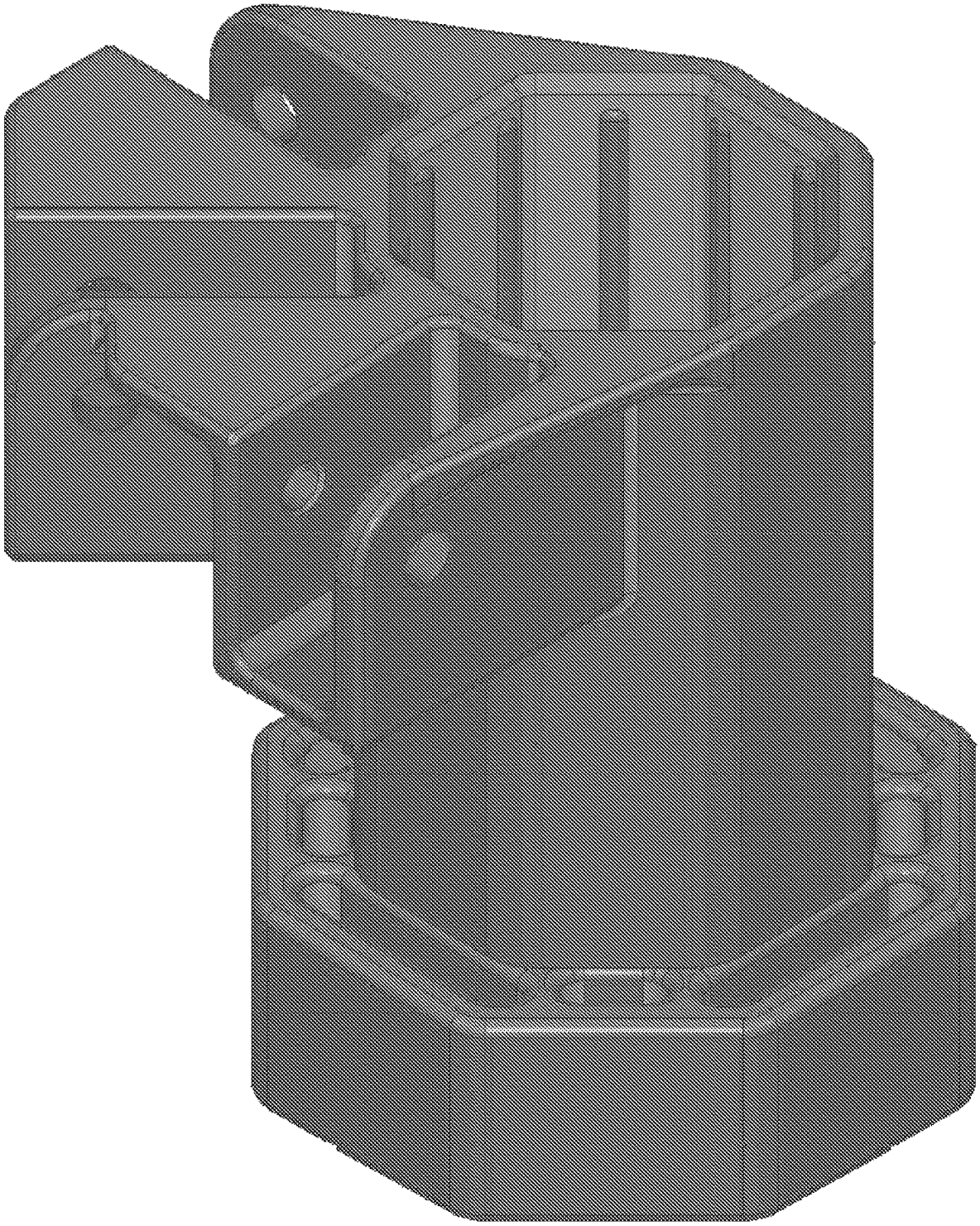
FIG. 42 is a perspective view of the hub of FIG. 24.
Figure 43:
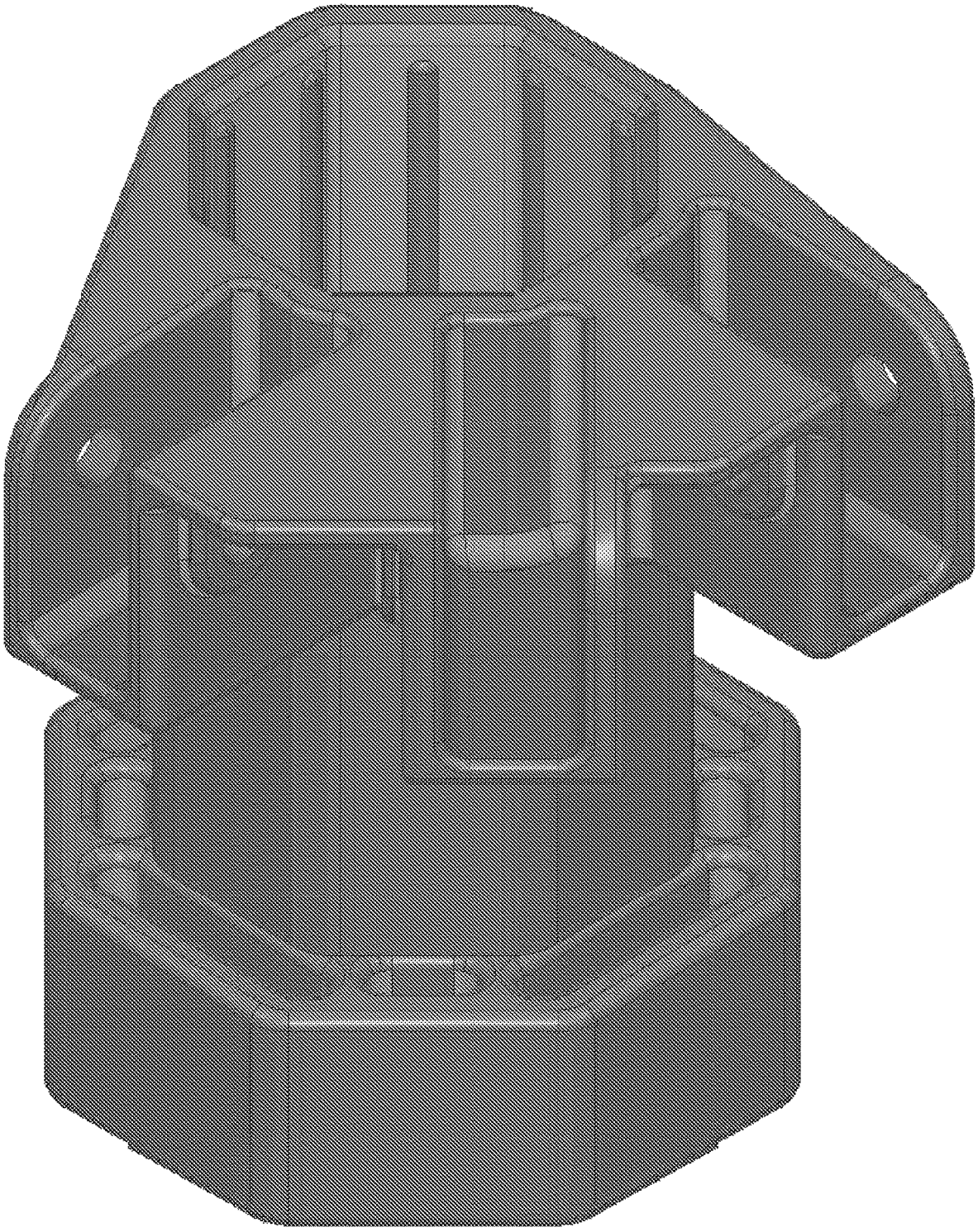
FIG. 43 is a perspective view of the hub of FIG. 24.
Figure 44:
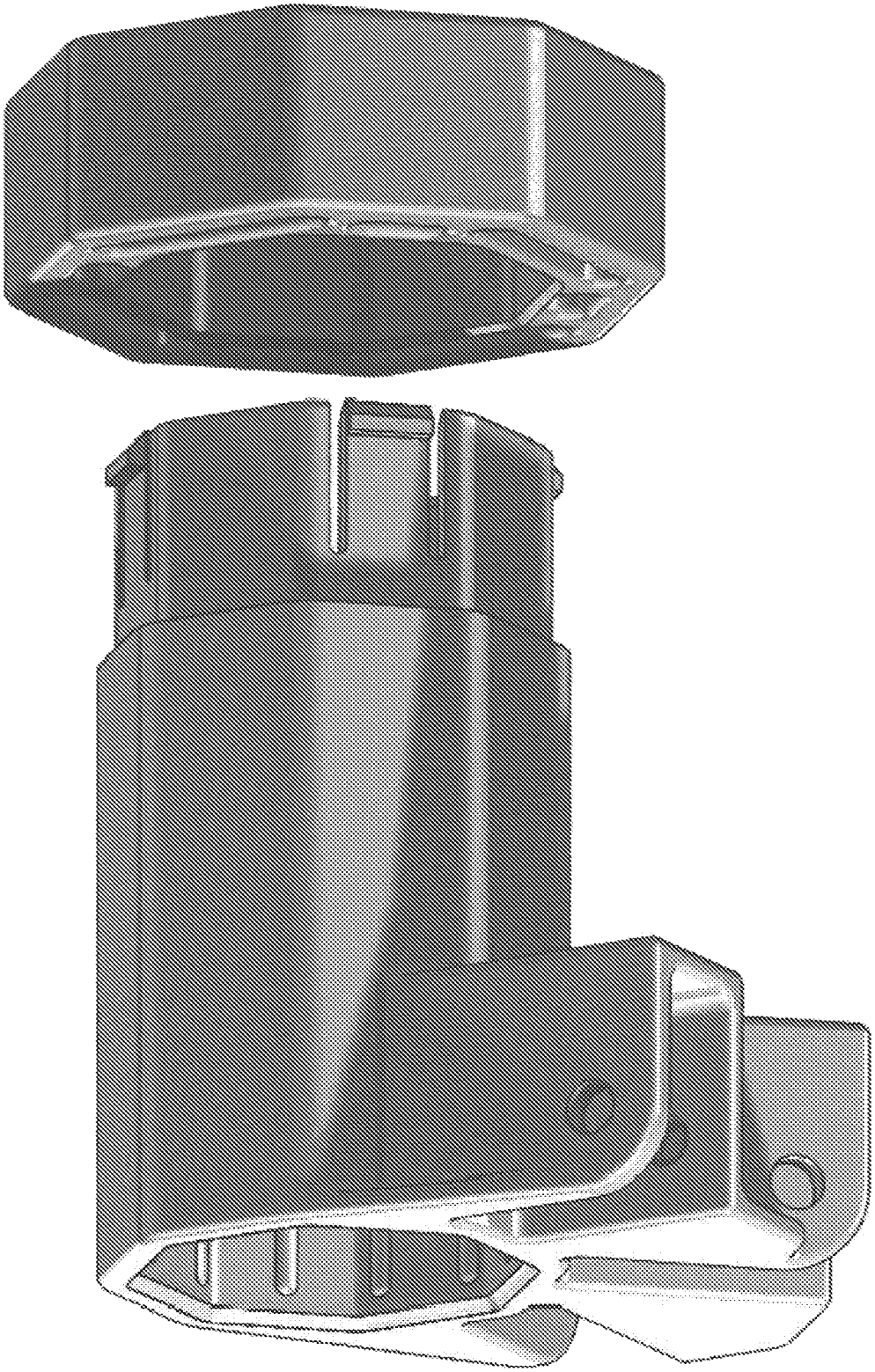
FIG. 44 is an alternate embodiment of the hub of FIG. 24.

FIG. 24 is an environmental view of a hub provided to an eight sided truss support slider. In the earlier figures, the legs were only four sided or substantially four sided. It is contemplated that the frame hub 1000 may be modified for placement onto a leg of any number of sides. FIG. 25 is an environmental view of a hub provided to a leg extensions slider for an eight sided leg. FIG. 26 is perspective view of the hub of FIG. 25. FIG. 27 is top view of the hub of FIG. 25. FIG. 28 is a bottom view of the hub of FIG. 25. FIG. 29 is a left-side view of the hub of FIG. 25. FIG. 30 is a right side view of the hub of FIG. 25. FIG. 31 is a back view of the hub of FIG. 25. FIG. 32 is a front view of the hub of FIG. 25. FIG. 33 is a perspective view of the hub of FIG. 25. FIG. 34 is a perspective view of the hub of FIG. 25. FIG. 35 is a perspective view of the hub of FIG. 24. FIG. 36 is a top view of the hub of FIG. 24. FIG. 37 is a bottom view of the hub of FIG. 24. FIG. 38 is a left-side view of the frame hub 1000 of FIG. 24. FIG. 39 is a right side view of the frame hub 1000 of FIG. 24. FIG. 40 is a back view of the frame hub 1000 of FIG. 24. FIG. 41 is a front view of the frame hub 1000 of FIG. 24. FIG. 42 is a perspective view of the frame hub 1000 of FIG. 24. FIG. 43 is a perspective view of the frame hub 1000 of FIG. 24. FIG. 44 is an alternate embodiment of the frame hub 1000 of FIG. 24. The operation of the hubs of FIGS. 24 and 25 are substantially similar to the frame hubs 1000 described above in connection with the earlier figures.

Figure 45A:
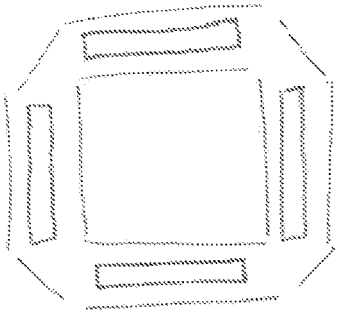
FIG. 45A is a top view of the hub of FIG. 45.
Figure 45B:
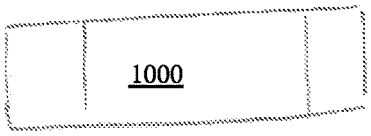
FIG. 45B is a front view of the hub of FIG. 45.
Figure 45:
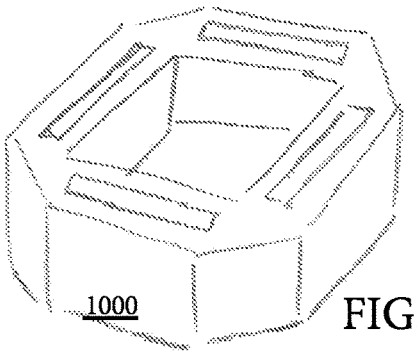
FIG. 45 is a repositionable hub that may be threaded by a leg of a canopy framework.
Figure 45C:
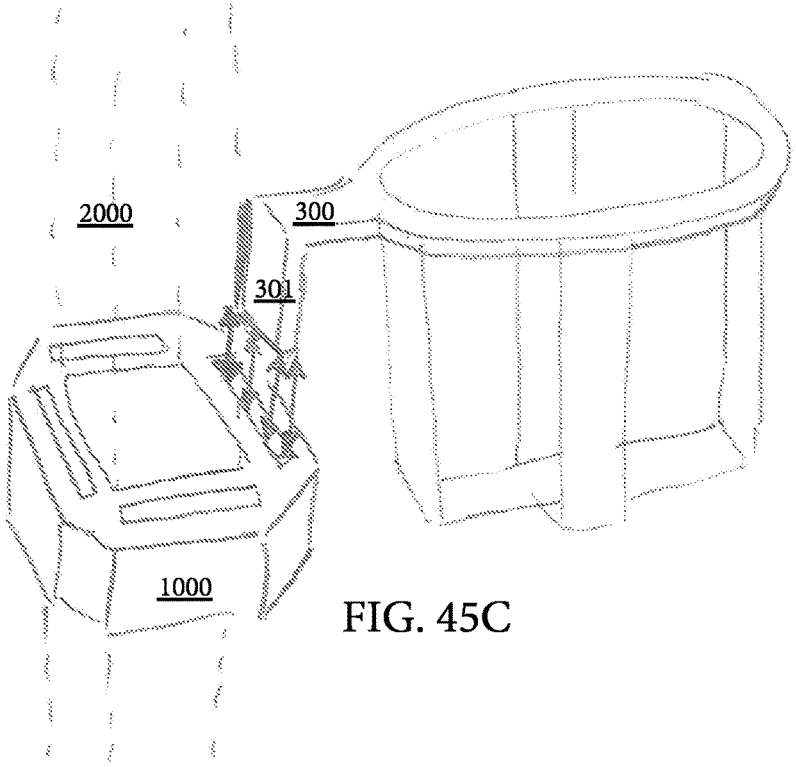
FIG. 45C is an environmental view of the hub of FIG. 45.
Figure 46A:
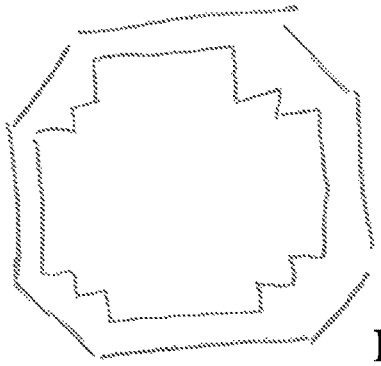
FIG. 46A is a top view of the hub of FIG. 46.
Figure 46B:
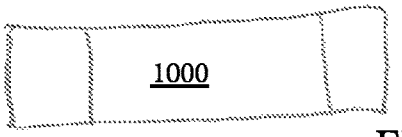
FIG. 46B is a front view of the hub of FIG. 46.
Figure 46:
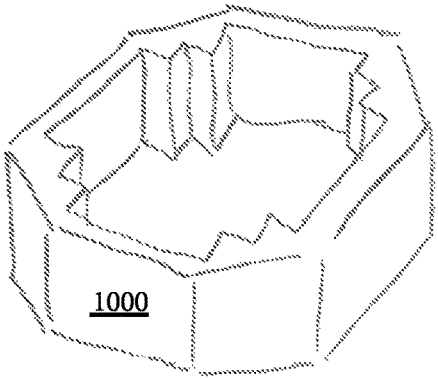
FIG. 46 is a repositionable hub that may be threaded by a leg of a canopy framework.
Figure 46C:
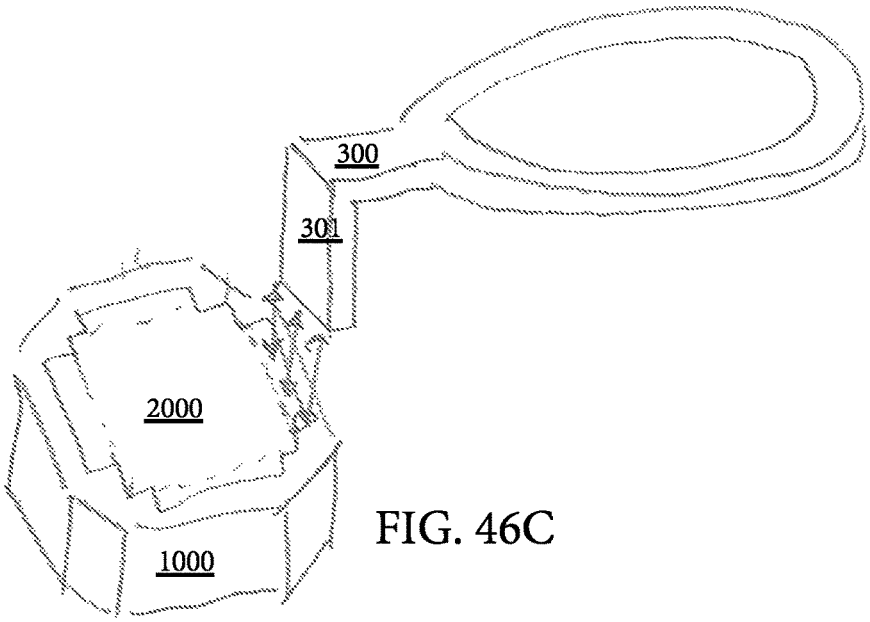
FIG. 46C is an environmental view of the hub of FIG. 46.

FIG. 45 is a frame hub 1000 that may be threaded by a leg of a canopy framework. FIG. 45A is a top view of the frame hub 1000 of FIG. 45. FIG. 45B is a front view of the frame hub 1000 of FIG. 45. FIG. 45C is an environmental view of the frame hub 1000 of FIG. 45 being mated with a cup holder 300. FIG. 46 is a frame hub 1000 that may be threaded by a leg of a canopy framework. FIG. 46A is a top view of the hub of FIG. 46. FIG. 46B is a front view of the frame hub 1000 of FIG. 46. The frame hubs 1000 depicted in FIGS. 45-46B may be fit to the canopy frame leg 2000 framework by restriction fit, set screw, or adhesive.

Figure 47:
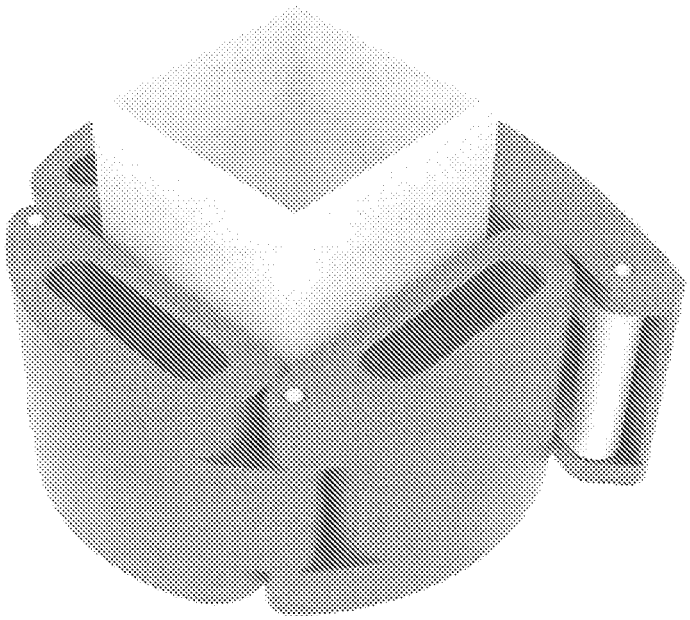
FIG. 47 is a front perspective of a hub that may be secured around a leg of a canopy framework.
Figure 48:
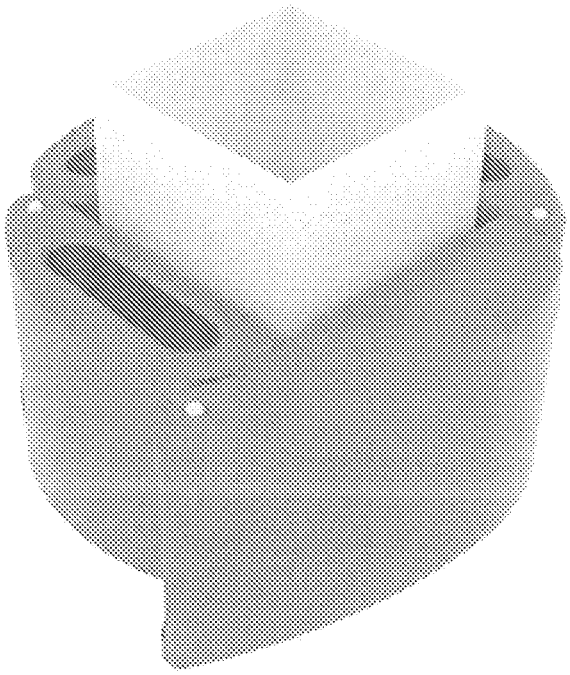
FIG. 48 is a different perspective of the hub of FIG. 47.
Figure 49:
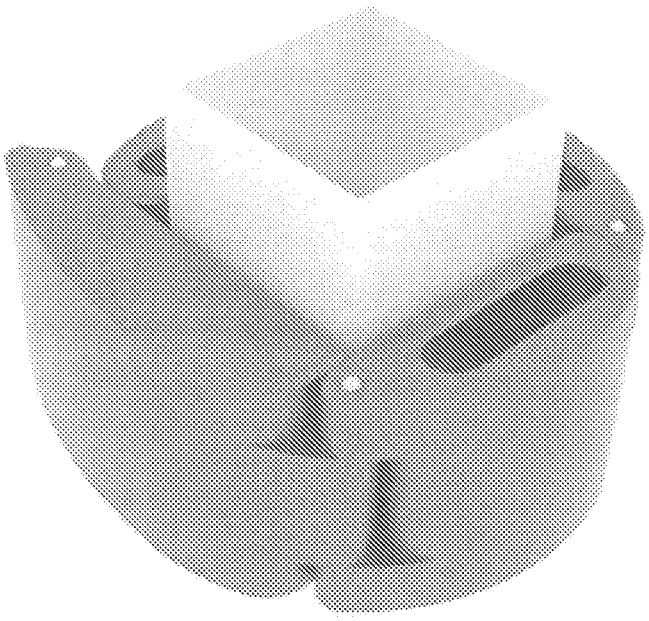
FIG. 49 is a different perspective of the hub of FIG. 47.
Figure 50:
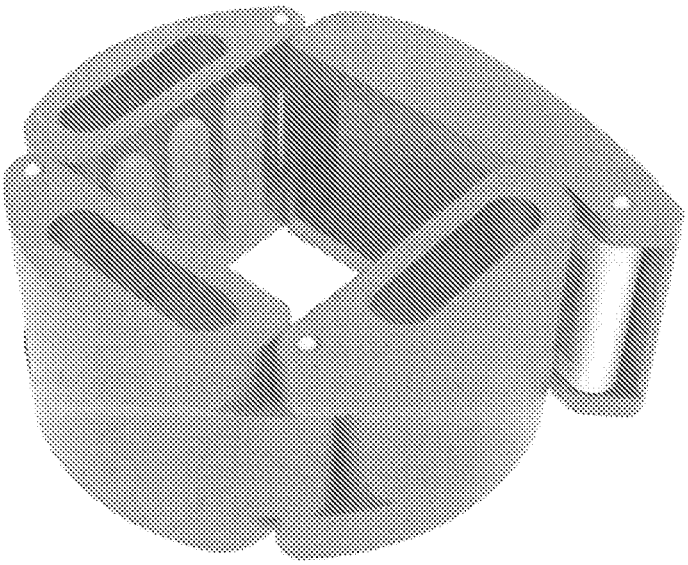
FIG. 50 is a different perspective of the hub of FIG. 47.
Figure 51:
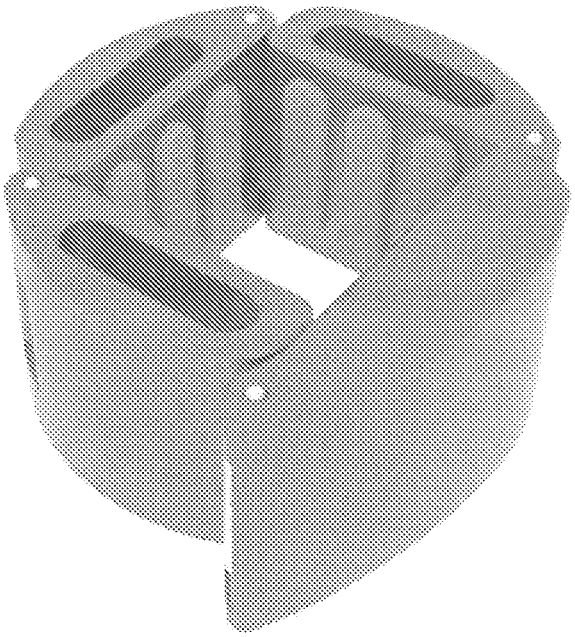
FIG. 51 is a different perspective of the hub of FIG. 47.
Figure 52:
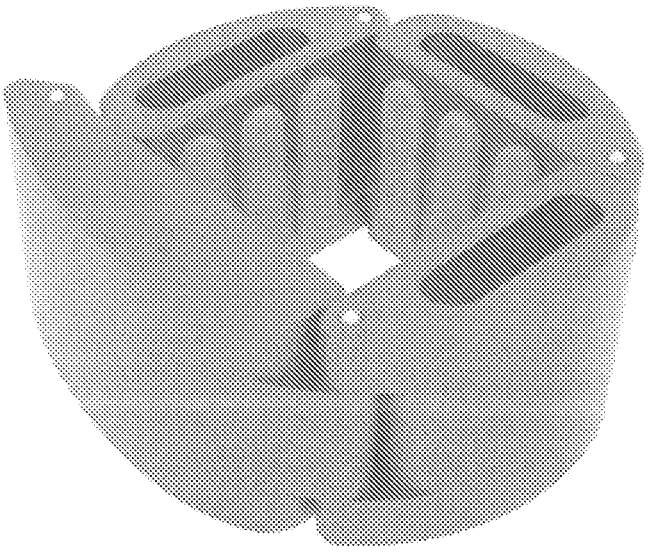
FIG. 52 is a different perspective of the hub of FIG. 47.
Figure 53:
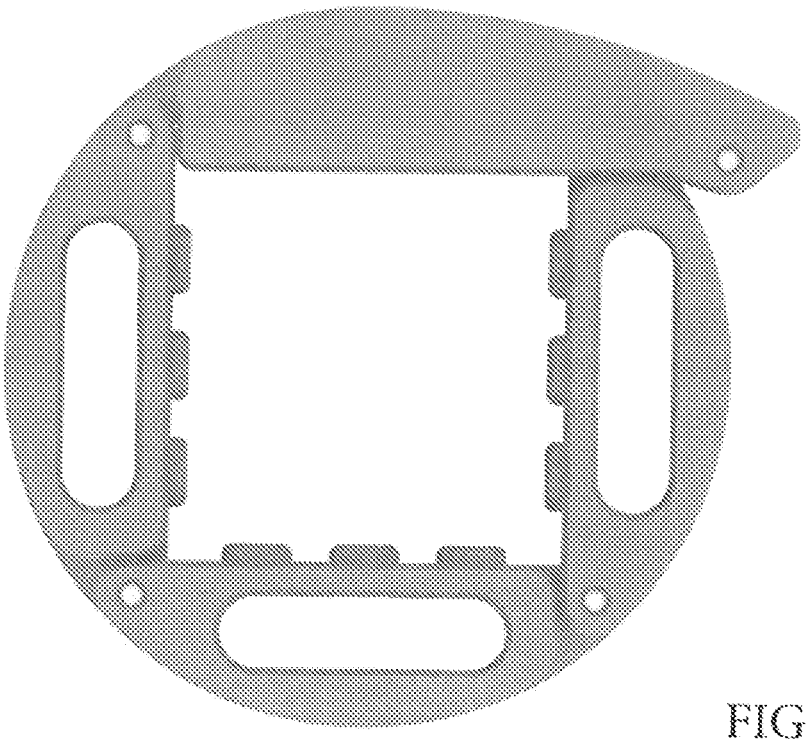
FIG. 53 is a top view of the hub of FIG. 47.
Figure 54:
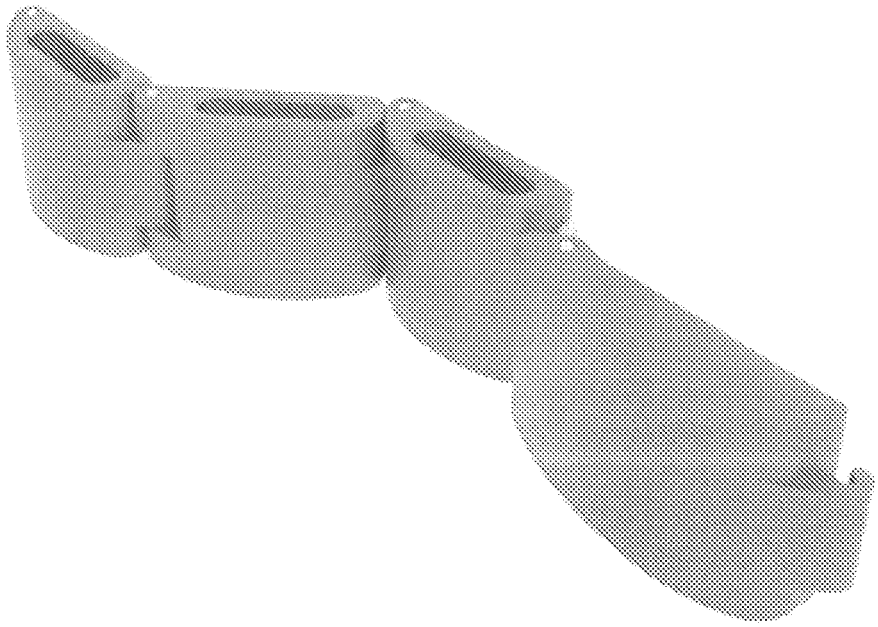
FIG. 54 is an unfurled view of the hub of FIG. 47.
Figure 55:
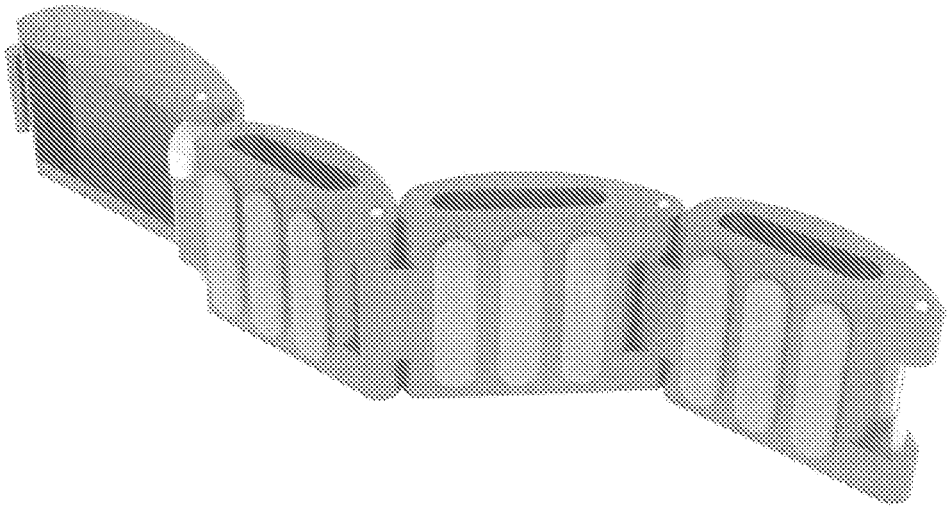
FIG. 55 is another unfurled view of the hub of FIG. 47.
Figure 56:
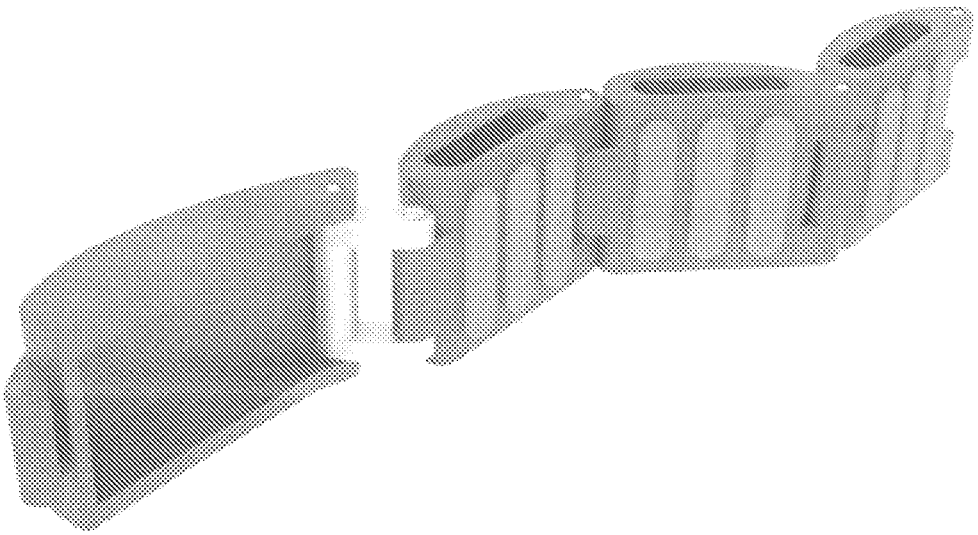
FIG. 56 is another unfurled view of the hub of FIG. 47.

FIG. 47 is a front perspective of a frame hub 1000 that may be secured around a leg of a canopy framework. FIG. 48 is a different perspective of the frame hub 1000 of FIG. 47. FIG. 49 is a different perspective of the frame hub 1000 of FIG. 47. FIG. 50 is a different perspective of the frame hub 1000 of FIG. 47. FIG. 51 is a different perspective of the frame hub 1000 of FIG. 47. FIG. 52 is a different perspective of the frame hub 1000 of FIG. 47. FIG. 53 is a top view of the frame hub 1000 of FIG. 47. FIG. 54 is an unfurled view of the frame hub 1000 of FIG. 47. FIG. 55 is an unfurled view of the frame hub 1000 of FIG. 47. FIG. 56 is another unfurled view of the frame hub 1000 of FIG. 47. As shown in these figures, the frame hub 1000 may be defined by flat surfaced chain links that can be wrapped around a leg of a canopy frame and ratchetedly connected to the leg.

Figure 57:
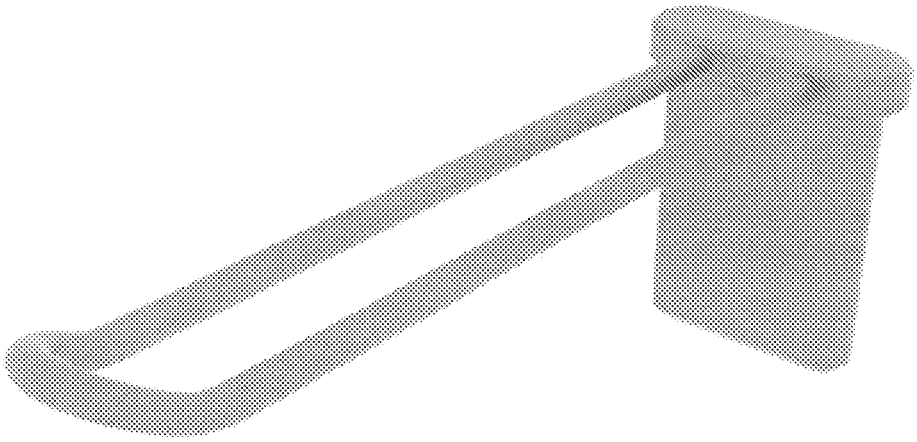
FIG. 57 is a hanger accessory that may be provided to the openings of a hub.
Figure 58:
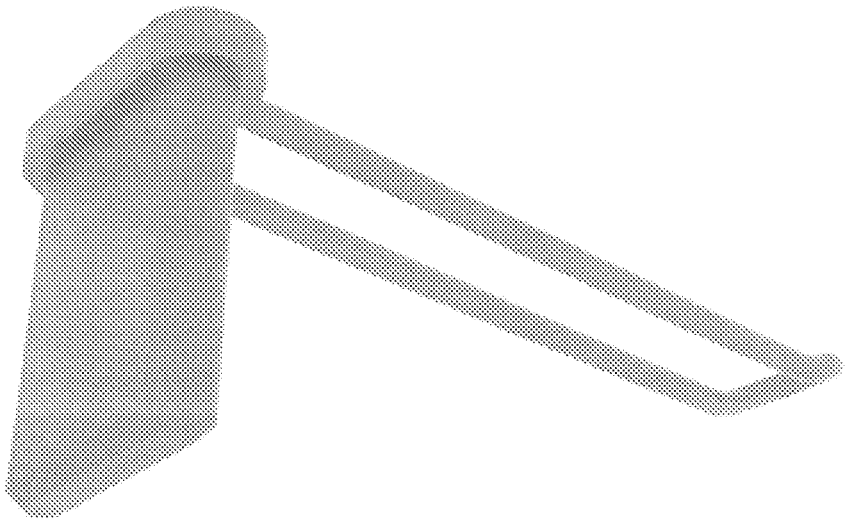
FIG. 58 is another view of the hanger accessory that may be provided to the openings of a hub.
Figure 59:
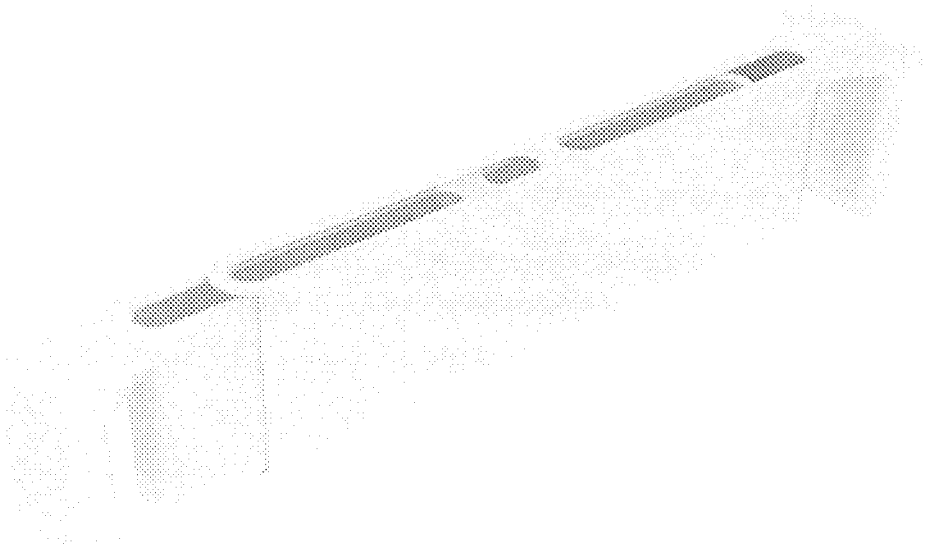
FIG. 59 is a support accessory that may be provided between two hubs.
Figure 60:
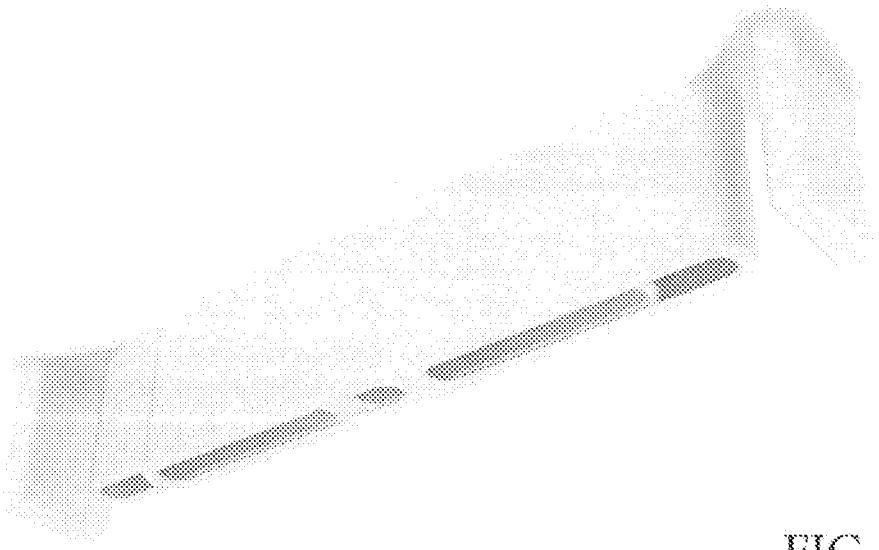
FIG. 60 is a support accessory that may be provided between two hubs.
Figure 61:
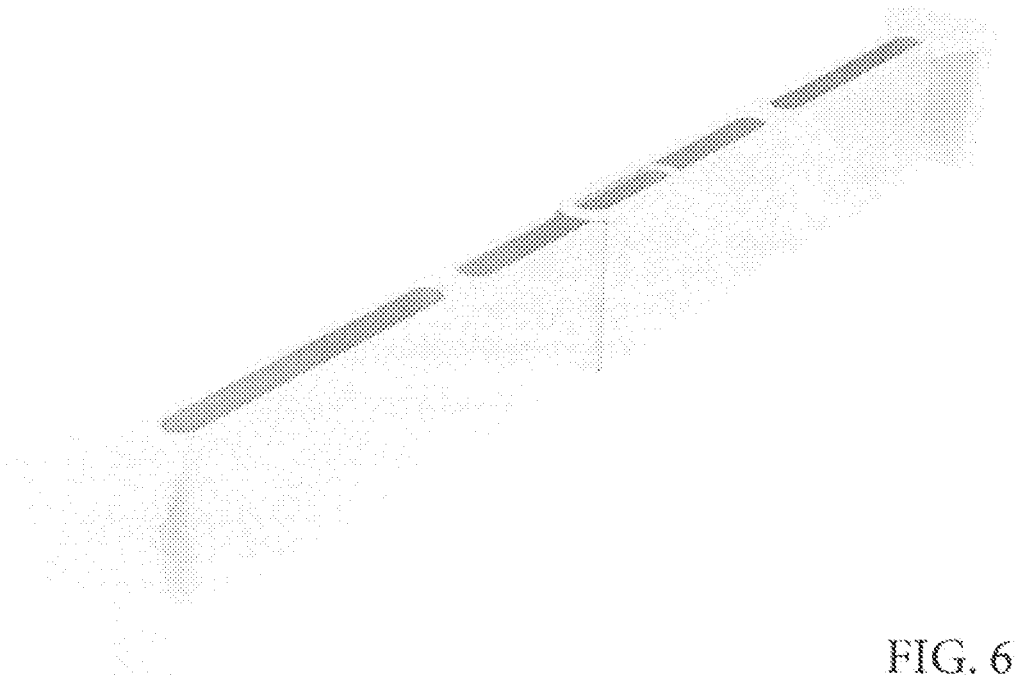
FIG. 61 is a support accessory that may be provided between two hubs.
Figure 62:
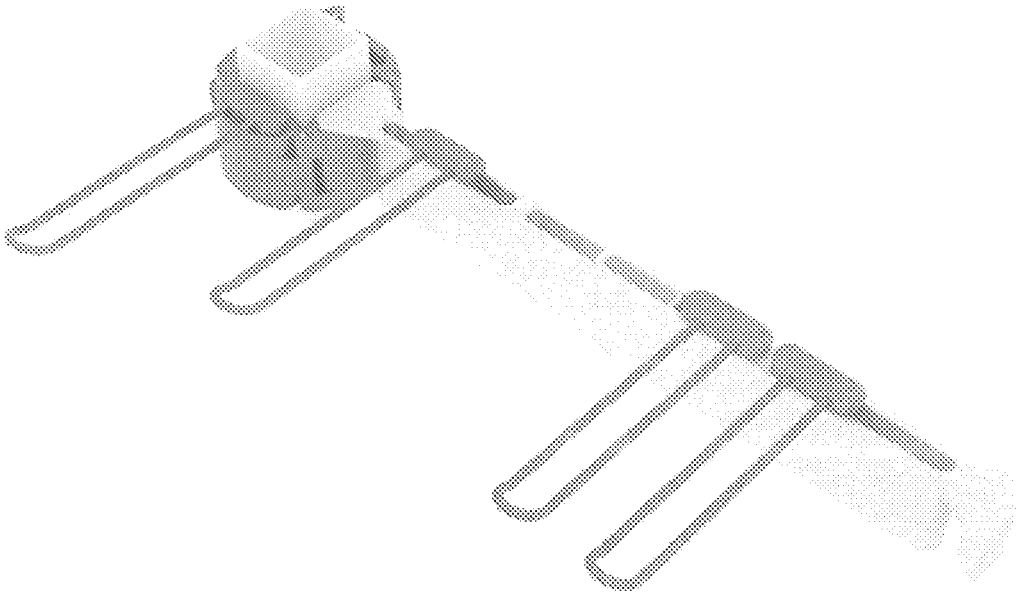
FIG. 62 is an environmental view of the hub and accessories of FIGS. 47, 57, and 59; and, FIG. 63 is an environmental view of the hub and accessories of FIGS. 47 and 57.
Figure 63:
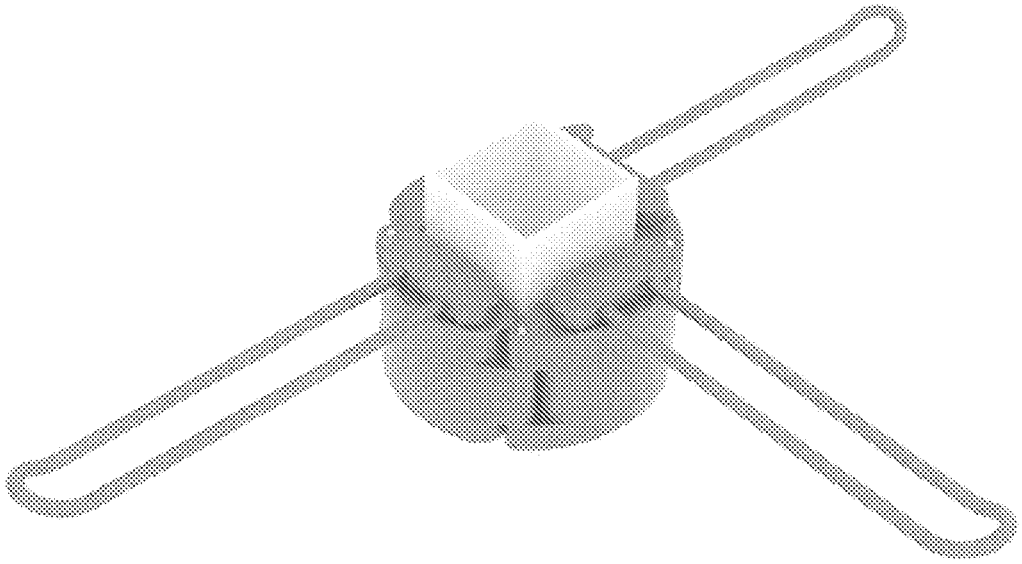

FIG. 57 is a hanger accessory that may be provided to the openings of a frame hub 1000. FIG. 58 is another view of the hanger accessory that may be provided to the openings of a frame hub 1000. FIG. 59 is a support accessory that may be provided between two frame hubs 1000. FIG. 60 is a support accessory that may be provided between two frame hubs 1000. FIG. 61 is a support accessory that may be provided between two frame hubs 1000. FIG. 62 is an environmental view of the frame hub 1000 and accessories of FIGS. 47, 57, and 59. FIG. 63 is an environmental view of the frame hub 1000 and accessories of FIGS. 47 and 57.

Although the method and apparatus is described above in terms of various exemplary embodiments and implementations, it should be understood that the various features, aspects and functionality described in one or more of the individual embodiments are not limited in their applicability to the particular embodiment with which they are described, but instead might be applied, alone or in various combinations, to one or more of the other embodiments of the disclosed method and apparatus, whether or not such embodiments are described and whether or not such features are presented as being a part of a described embodiment. Thus the breadth and scope of the claimed invention should not be limited by any of the above-described embodiments.

Terms and phrases used in this document, and variations thereof, unless otherwise expressly stated, should be construed as open-ended as opposed to limiting. As examples of the foregoing: the term "including" should be read as meaning "including, without limitation" or the like, the term "example" is used to provide exemplary instances of the item in discussion, not an exhaustive or limiting list thereof, the terms "a" or "an" should be read as meaning "at least one," "one or more," or the like, and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that might be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases might be absent. The use of the term "assembly" does not imply that the components or functionality described or claimed as part of the module are all configured in a common package. Indeed, any or all of the various components of a module, whether control logic or other components, might be combined in a single package or separately maintained and might further be distributed across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives might be implemented without confinement to the illustrated examples. For example, block diagrams and their accompanying description should not be construed as mandating a particular architecture or configuration.

All original claims submitted with this specification are incorporated by reference in their entirety as if fully set forth herein.

I claim:

1. A hub that secures a truss of a canopy frame to a leg of the canopy frame while supporting an attachment, said hub comprising:

a central opening that has received the leg of the canopy frame so that the leg of the canopy frame extends upward relative to and is encompassed by the hub;

a plurality of portals disposed around the central opening, wherein one of the portals receives a digit of the attachment; and a truss support cap disposed on and extending from at least one side of the central opening, wherein the truss support cap features a truss portal that is attached to the truss of the canopy frame so that the truss extends upward from the truss support cap at an acute angle relative to the leg of the canopy frame.

* * * * *